US005754148A

United States Patent [19]

Kishino et al.

[11] Patent Number: 5,754,148

[45] Date of Patent: May 19, 1998

[54] FIELD EMISSION TYPE DEVICE, FIELD EMISSION TYPE IMAGE DISPLAYING APPARATUS, AND DRIVING METHOD THEREOF

[75] Inventors: Takao Kishino, Mobara; Kazuyuki Yano, Ichihara; Mitsuru Tanaka, Chiba, all of Japan

[73] Assignee: Futoba Corporation, Japan

[21] Appl. No.: 607,867

[22] Filed: Feb. 27, 1996

[30] Foreign Application Priority Data

Feb. 28, 1995 [JP] Japan ..... 7-063464
Apr. 17, 1995 [JP] Japan ..... 7-114134

[51] Int. Cl.[6] ..... G09G 3/22

[52] U.S. Cl. ..... 345/74; 313/495

[58] Field of Search ..... 345/74, 75, 55, 345/66, 62, 67, 150, 151; 315/169.3, 169.4, 349; 313/495, 496, 497

[56] References Cited

U.S. PATENT DOCUMENTS 4,112,332 9/1978 Veith et al. ..... 345/72
5,231,387 7/1993 Clerc ..... 345/76
5,459,480 10/1997 Browning et al. ..... 345/75
5,557,296 9/1996 Lambert et al. ..... 345/74

*Primary Examiner*—Dennis-Doon Chow
*Attorney, Agent, or Firm*—Pollock, Vande Sande & Priddy

[57] ABSTRACT

In a field emission type device, pairs of patch-shaped cathode electrodes 3 are disposed on each of cathode electrodes 2 with an insulation in the line direction. Even-numbered patch-shaped gate electrodes 3 are connected to a first gate lead electrode GT1 on a line perpendicular to the cathode electrodes 2. Odd-numbered patch-shaped gate electrodes are connected to a second gate lead electrode GT2. An anode electrode 8 with a phosphor is disposed opposite to the patch-shaped gate electrodes 3. The first gate lead electrode GT1 and the second gate lead electrode GT2 are alternatively driven. The voltage of one of the first gate lead electrode GT1 and the second gate lead electrode GT2 is set to a ground level. Image data is supplied to cathode lead electrodes Cl to Ck. The voltage of the patch-shaped gate electrodes disposed adjacent to a patch-shaped gate electrode 3 that is driven is set to the ground level. Thus, electrons emitted are focused.

17 Claims, 22 Drawing Sheets

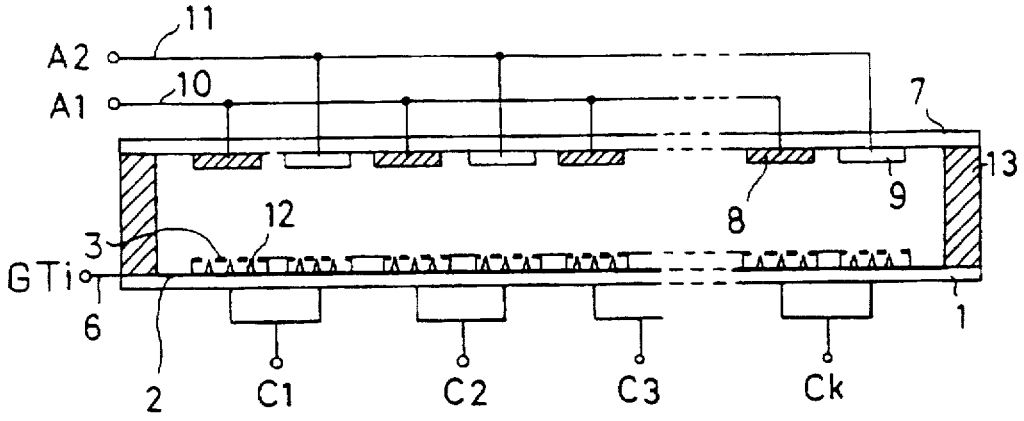
FIG.3 (a)
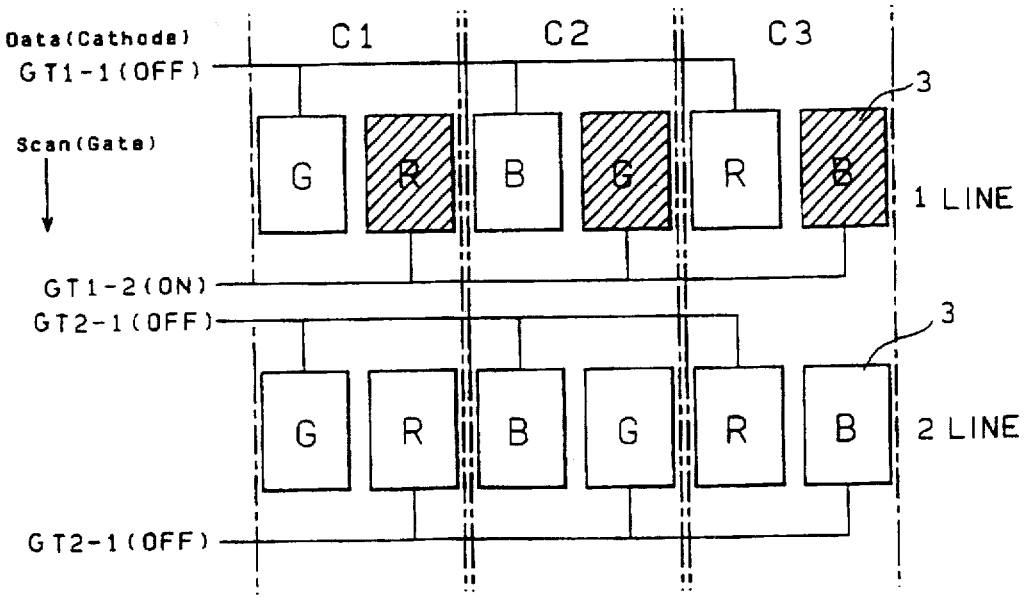
FIG.3 ( b )

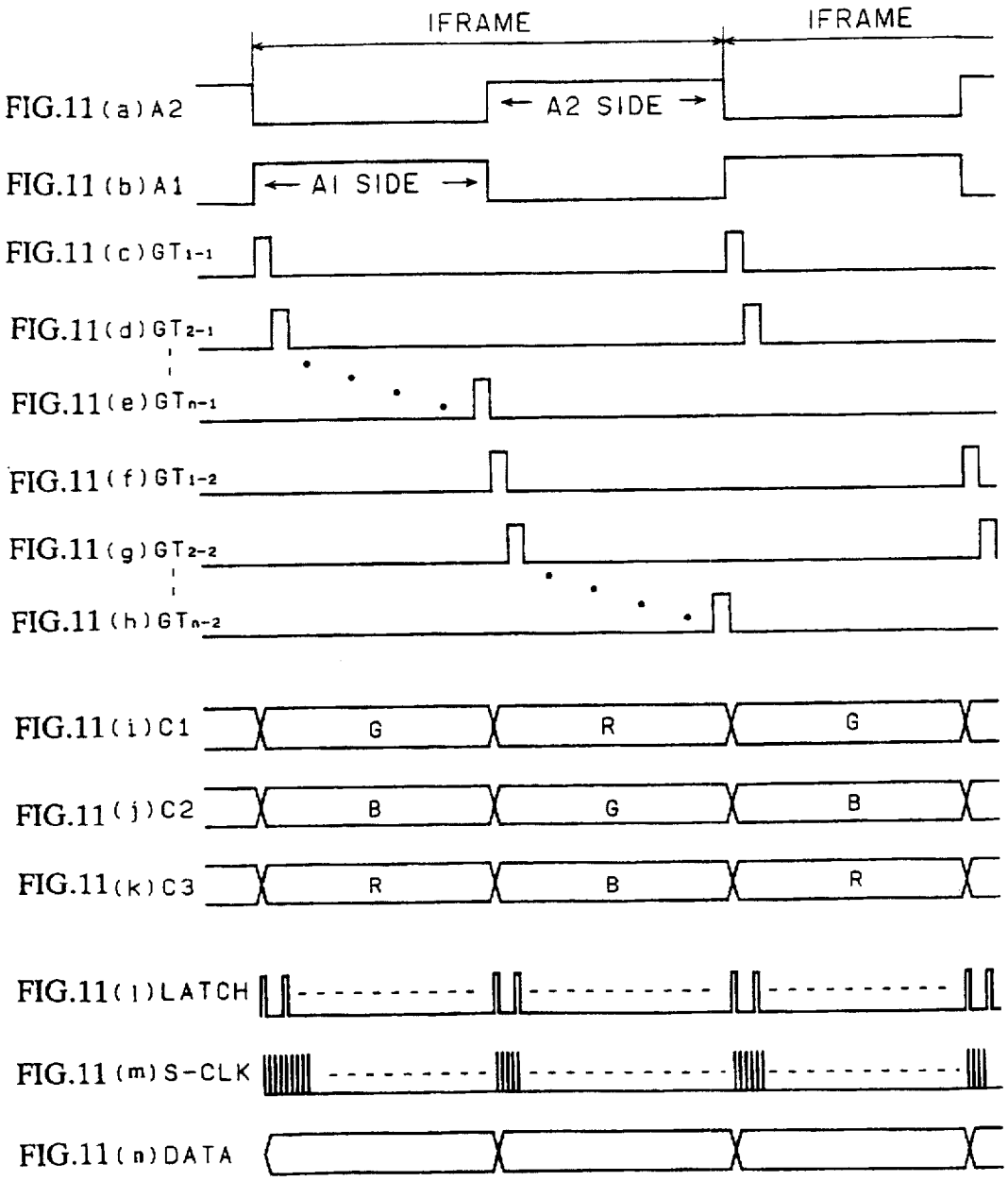
IFRAME
IFRAME
FIG.11(a)A2
← A2 SIDE →
FIG.11(b)A1
← A1 SIDE →
FIG.11(c)GT1-1
FIG.11(d)GT2-1
FIG.11(e)GTn-1
FIG.11(f)GT1-2
FIG.11(g)GT2-2
FIG.11(h)GTn-2
FIG.11(i)C1
G
R
G
FIG.11(j)C2
B
G
B
FIG.11(k)C3
R
B
R
FIG.11(l)LATCH
FIG.11(m)S-CLK
FIG.11(n)DATA FIG.12 (a)ANODE A1 GATE GT1-1
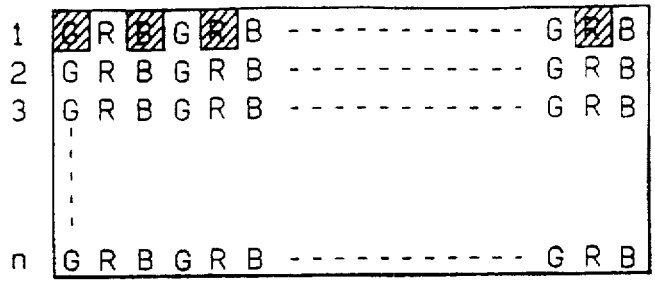
FIG.12 (b)ANODE A1 GATE GT2-1
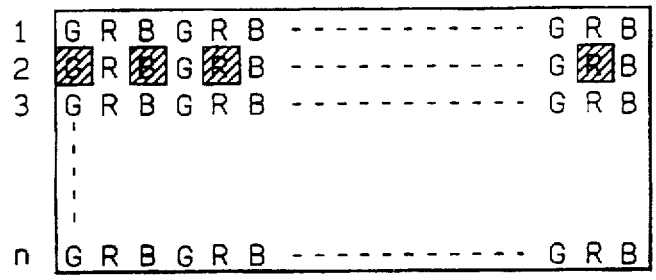
FIG.12 (c)ANODE A2 GATE GT1-2
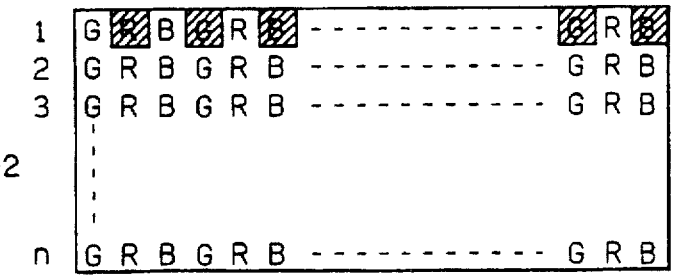
FIG.12 (d)ANODE A2 GATE GT2-2
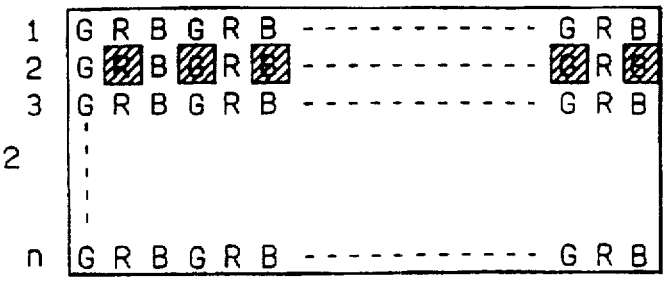

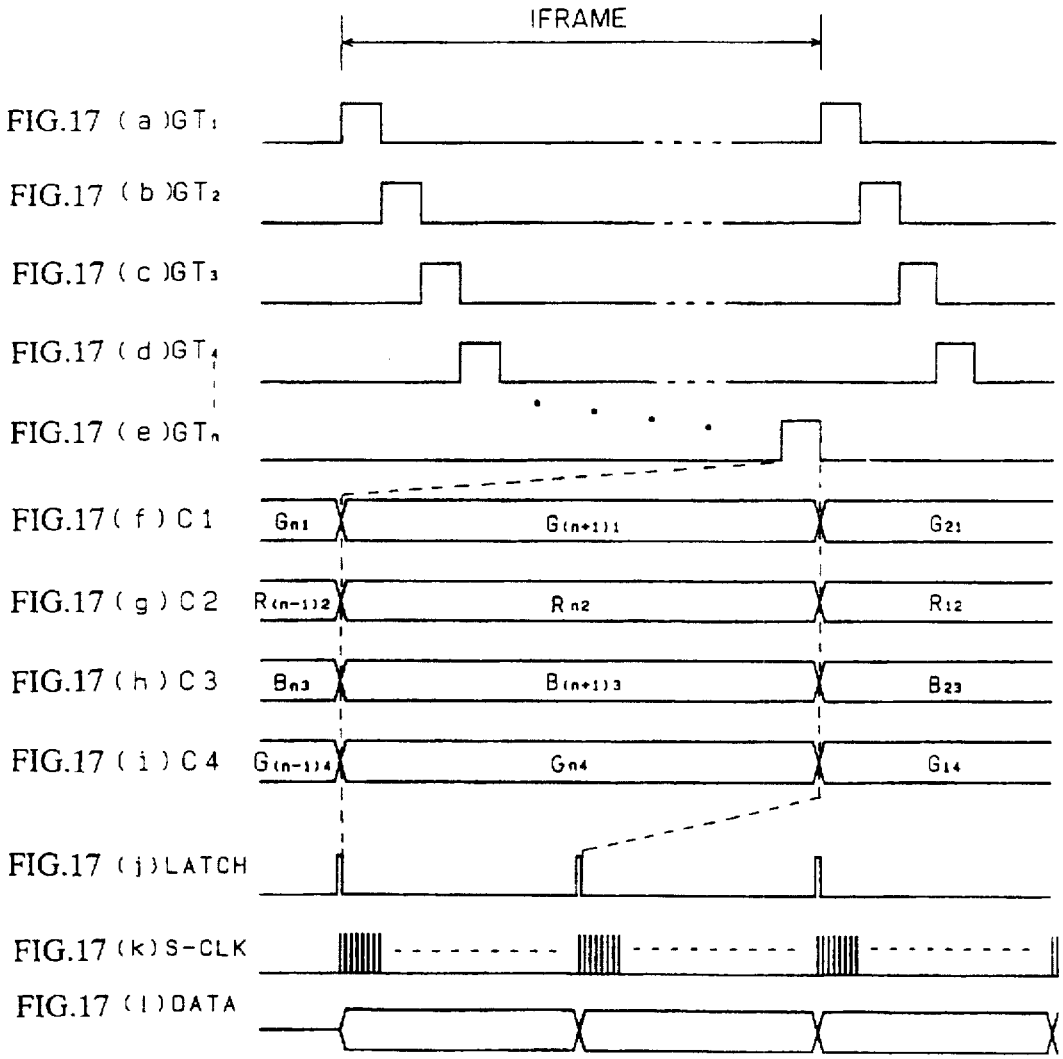
1FRAME
FIG.17 (a) GT1
FIG.17 (b) GT2
FIG.17 (c) GT3
FIG.17 (d) GT4
FIG.17 (e) GTn
FIG.17 (f) C1
Gn1
G(n+1)1
G21
FIG.17 (g) C2
R(n-1)2
Rn2
R12
FIG.17 (h) C3
Bn3
B(n+1)3
B23
FIG.17 (i) C4
G(n-1)4
Gn4
G14
FIG.17 (j) LATCH
FIG.17 (k) S-CLK
FIG.17 (l) DATA FIG.18 (a)GATE GT1
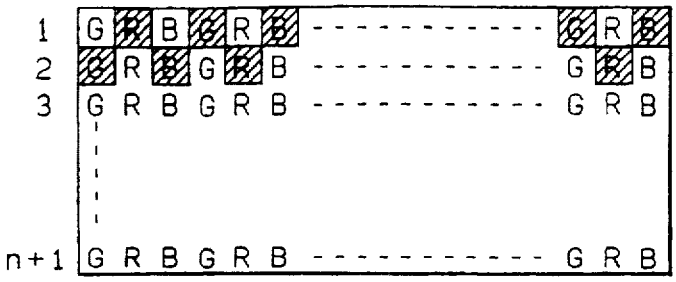
FIG.18 (b)GATE GT2
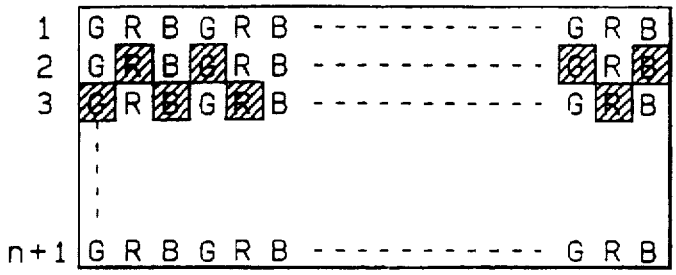
FIG.18 (c)GATE GT3
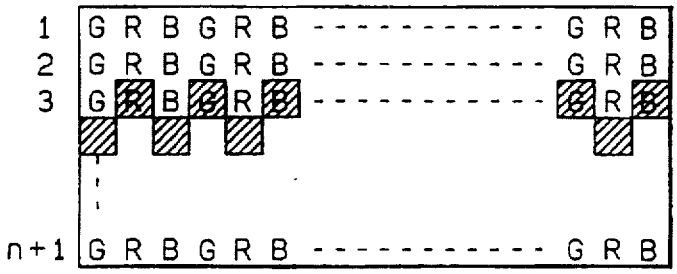
FIG.18 (d)GATE GTn
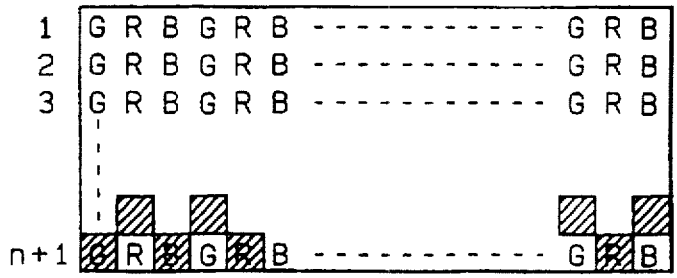

FIG.20 (a) A1
FIG.20 (b) A2
FIG.20 (c) GTi-1
FIG.20 (d) GTi
FIG.20 (e) GTi+1
FIG.20 (f) GTi+2
FIG.20 (g) C1
FIG.20 (h) C2
FIG.20 (i) C3
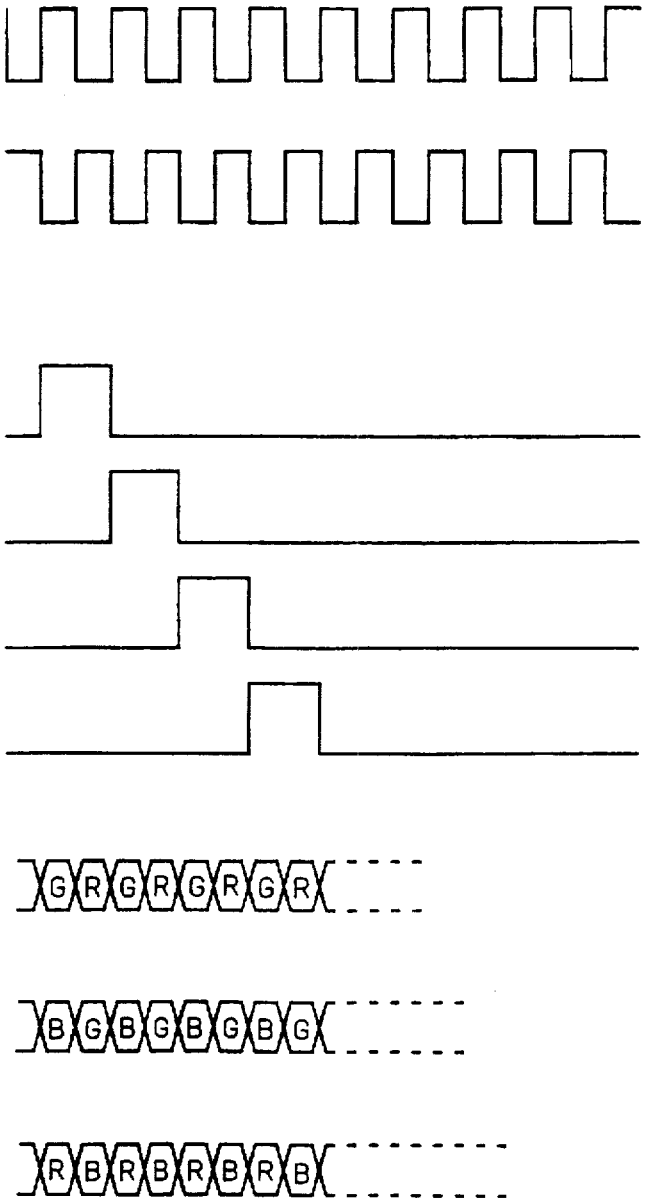

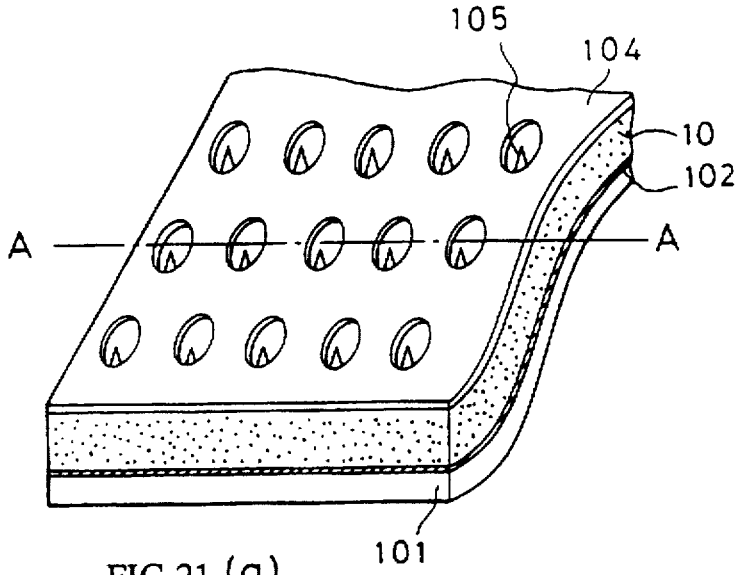
FIG.21 (a) CONVENTIONAL ART
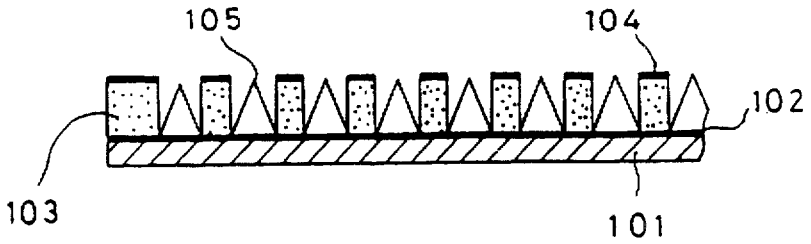
FIG.21 (b) CONVENTIONAL ART

FIELD EMISSION TYPE DEVICE, FIELD EMISSION TYPE IMAGE DISPLAYING APPARATUS, AND DRIVING METHOD THEREOF

BACKGROUND OF THE INVENTION

1. Field of the Invention

The present invention relates to a field emission type device for emitting electrons in an electric field, a field emission type image displaying apparatus, and a driving method thereof.

2. Description of the Prior Art

When the intensity of the electric field on the surface of a metal or a semiconductor becomes around $10^9$ [V/m], electrons are emitted through an electron barrier in vacuum even at a normal temperature. This phenomenon is referred to as field emission. A cathode that emits electrons corresponding to such a theory is referred to as field emission type cathode (FEC).

In recent years, with semiconductor forming technologies, a surface emission type FEC composed of an FEC on micron order has been fabricated.

FIGS. 21(*a*) and 21(*b*) show an outlined structure of a field emission type cathode of Spindt type.

FIG. 21(*a*) is a perspective view showing the FEC fabricated by a microfabrication technology. FIG. 21(*b*) is a sectional view taken along line A—A of FIG. 21(*a*).

Referring to FIGS. 21(*a*) and 21(*b*), a cathode electrode 102 is disposed on a base 101 by an evaporation method or the like. Cone-shaped emitters 105 are disposed on the cathode electrode 102. A gate electrode 104 is disposed on the cathode electrode 102 through an insulation layer 103 composed of silicon dioxide ($SiO_2$). The cone-shaped emitters 105 are disposed in holes formed in the gate electrode 104.

In other words, the top portion of each of the cone-shaped emitters 105 is exposed from the hole formed in the gate electrode 104.

A plurality of cone-shaped emitters 105 can be formed at pitches of 10 microns or less by the microfabrication technology. Thus, FECs on the order of several ten thousands to several hundred thousands can be disposed on the base 101.

In addition, since the distance between the gate electrode 104 and the top portion of each of the emitters 105 can be formed on the order of sub-microns, when a voltage as low as several ten volts is applied between the gate electrode 104 and the cathode electrode 102, electrons can be emitted from the emitters 105.

Moreover, as shown in FIGS. 21(*a*) and 21(*b*), the FEC can be formed as a surface emission type. As an application technology of the FEC of the surface emission type, a flat color display apparatus has been proposed (refer to Japanese Patent Laid-Open Publication No. 2-61946).

FIGS. 22 and 23 show the structure of such a conventional color display apparatus.

An array of conductive cathode electrodes 112 is disposed on a first base 110 composed of glass. Emitters 114 that emit electrons and composed of a metal are supported by the cathode electrodes 112. The array of the cathode electrodes 112 intersects with an array of grid electrodes 116 that have holes.

Top portions of the emitters 114 disposed at intersections of the array of the grid electrodes 116 and the array of the cathode electrodes 112 face upward. The array of the cathode electrodes 112 and the array of the grid electrodes 116 are spaced apart by an insulation layer 118. The insulation layer 118 has holes for emitting electrons.

A second base 122 composed of glass is disposed opposite to the first base 110. A plurality of anode electrodes 126 are disposed in parallel on the second base 122. The anode electrodes 126 are coated with red, green, and blue phosphors 128, 129, and 130, one after the other.

Each of the cathode electrodes 112 is disposed for every three anode electrodes 126 coated with the red, green, and blue phosphors 128, 129, and 130. To selectively cause any color phosphor to light, as shown in FIG. 23, the anode electrodes 126 are divided into three groups corresponding to the red, green, and blue colors and connected to three anode lead electrodes 132, 134, and 136. In other words, the anode electrodes 126 connected to the anode lead electrode 132 are coated with the red phosphor 128. The anode electrodes 126 connected to the anode lead electrode 134 are coated with the green phosphor 129. The anode electrodes 126 connected to the anode lead electrode 136 are coated with the blue phosphor 130.

To display a color image on the color display apparatus, the gate electrodes 116 are successively scanned and driven one after the other. Image data of pixels corresponding to one line selected by the driven gate electrodes 116 is supplied to the cathode electrodes 112. At the timing of which one gate electrode 116 is being driven, the three anode lead electrodes 132, 134, and 136 are successively selected and driven. In this case, image data of colors corresponding to the selectively driven anode lead electrode 132, 134, or 136 is supplied to the cathode electrode 112.

When all the gate electrodes 116 have been successively scanned, driven, and selected, a full color image of one frame is displayed on the second base 122.

When the anode electrodes are divided into three groups, as shown in FIG. 23, since the anode electrodes 126 are disposed on the second base 112, the three anode lead electrodes 132, 134, and 136 should be led out of the second base 122.

However, when the three anode lead electrodes 132, 134, and 136 are led out of the second base 122, as shown in FIG. 23, the anode lead electrodes partially overlap. Thus, these overlapped portions should be formed as a multilayer inter connection. In addition, since the anode electrodes are divided into three groups and selectively driven, the duty of the apparatus becomes ⅓. Thus, the luminance cannot be improved.

To solve such problems, one anode electrode is disposed on the entire surface of the second base (thus, one anode lead electrode is used). R, G, and B phosphors are disposed in a stripe shape (in parallel) on the anode electrode. Cathode electrodes are disposed corresponding to the stripe-shaped phosphors in the one-to-one relation. In this structure, by scanning the gate electrodes, a color image display apparatus that does not need such a multilayer inter connection can be accomplished.

However, in such an image display apparatus, electrons emitted from the emitters disposed on the cathode electrodes reach the anode electrode with a spreading angle of around 30 degrees as a half angle. Thus, electrons that spread to some extent reach the anode electrode. Consequently, the electrons cause different phosphors adjacent to a target phosphor on the anode electrode to light. As a result, the resultant color image becomes dull.

Therefore, an object of the present invention is to provide a field emission type device that can focus electrons emitted in an electric field and a driving method thereof.

Another object of the present invention is to provide a color field emission type image display apparatus for allowing a lead of an anode electrode to be led out without need to use a multilayer inter connection and the luminance to be improved free of dullness of colors.

SUMMARY OF THE INVENTION

To accomplish the above-described objects, a field emission type device according to the present invention comprises a plurality of cathode electrodes disposed on a base and having emitters corresponding thereto for performing field emissions, a plurality of patch-shaped gate electrodes disposed on the cathode electrodes with an insulation in an almost linear shape, a first gate lead electrode connected to odd-numbered ones of the patch-shaped gate electrodes, and a second gate lead electrode connected to the remaining even-numbered ones of the patch-shaped gate electrodes.

A driving method for driving a field emission device according to the present invention comprises the steps of alternately selecting and driving the first gate lead electrode and the second gate lead electrode, and setting the voltage of the first gate lead electrode or the second gate lead electrode that is not selected and driven to a low level, whereby electrons emitted from the emitters are focused.

To accomplish the above-described objects, a field emission type image display apparatus according to the present invention comprises a plurality of stripe-shaped cathode electrodes disposed on a first base and having emitters corresponding thereto for performing field emissions, a plurality of cathode lead electrodes for supplying signals to the cathode electrodes, a plurality of patch-shaped gate electrodes disposed on the cathode electrodes in a matrix shape with an insulation, a first gate lead electrode connected to odd-numbered ones of the patch-shaped gate electrodes disposed on each line of the patch-shaped gate electrodes disposed in the direction nearly perpendicular to the cathode electrodes, a second gate lead electrode connected to the remaining even-numbered ones of the patch-shaped gate electrode on the same line of the first gate lead electrode, a second base spaced apart from the first base by a predetermined distance, a plurality of stripe-shaped anode electrodes disposed on the second base and opposite to the cathode electrodes, a plurality of phosphor members successively disposed on the stripe-shaped anode electrodes and adapted for displaying an image, a first anode lead electrode connected to odd-numbered ones of the stripe-shaped anode electrodes, and a second anode lead electrode connected to the remaining even-numbered ones of the stripe-shaped anode electrodes, wherein a row of the patch-shaped gate electrodes is disposed just below the stripe-shaped anode electrodes.

In the field emission type image display apparatus, a signal that is received from one of the cathode lead electrodes is supplied to one of the cathode electrodes disposed opposite to the pairs of the patch-shaped electrodes disposed in the line direction.

Each of the patch-shaped gate electrodes of each line of the matrix is disposed on a corresponding one of the cathode electrodes.

The cathode electrodes are divided into two groups in the line direction. The patch-shaped gate electrodes are divided into two groups in the line direction. The first gate lead electrode is connected to each line of one of the two groups and the second gate lead electrode is connected to the corresponding line of the other of the two groups.

Another field emission type image display apparatus according to the present invention comprises a plurality of stripe-shaped cathode electrodes disposed on a first base and having emitters corresponding thereto for performing field emissions, a plurality of cathode lead electrodes for supplying signals to the cathode electrodes, a plurality of patch-shaped gate electrodes disposed on the cathode electrodes in a matrix shape with an insulation, a plurality of gate lead electrodes connected to every second ones of the patch-shaped gate electrodes for adjacent two lines of the matrix in a zigzag shape and led out of a portion between the two lines, a plane-shaped anode electrode disposed on a second base spaced apart from the first base by a predetermined distance so that the plane-shaped anode electrode is disposed opposite to the all of the patch-shaped gate electrodes, and a plurality of stripe-shaped phosphor members disposed on the plane-shaped anode electrode and opposite to the cathode electrodes in the one-to-one relation.

In the other field emission type image display apparatus, a signal that is received from one of the cathode lead electrodes is supplied to one of the cathode electrodes disposed opposite to the pairs of the patch-shaped electrodes disposed in the line direction. The stripe-shaped anode electrodes are disposed on each row of the patch-shaped electrodes. Two anode lead electrodes are connected to odd-numbered ones and even-numbered ones of the stripe-shaped anode electrodes, respectively.

The cathode electrodes are divided into two groups in the line direction. The patch-shaped gate electrodes are divided into two groups in the line direction. The gate lead electrode is led out of each line of one of the two groups and the corresponding line of the other of the two groups.

A driving method for driving a field emission type image display apparatus according to the present invention comprises the steps of selecting and driving the first gate lead electrode and the second gate lead electrode so as to alternately scan the first gate lead electrode and the second gate lead electrode, setting the voltage of the first gate lead electrode or the second gate lead electrode that is not driven to a low level so that the voltages of the patch-shaped gate electrodes disposed adjacent to one of the patch-shaped gate electrodes that is selected and driven become a low level, and setting the voltages of the anode electrodes that are not selected and driven to a low level, whereby electrons emitted from the emitters are focused.

A driving method for driving the other field emission type image display apparatus comprises the steps of successively selecting and driving the gate lead electrodes so as to scan the gate lead electrodes, and setting the voltages of the gate lead electrodes that are not selected and driven to a low level so that the voltages of the patch-shaped gate electrodes that are disposed adjacent to one of the patch-shaped gate electrodes that is selected and driven become a low level, whereby electrons emitted from the emitters are focused.

According to the field emission type device of the present invention, since the patch-shaped gate electrodes are alternately driven, the adjacent patch-shaped gate electrodes can be prevented from being driven. Thus, the electrons that are emitted can be focused.

In addition, according to the field emission type image display apparatus of the present invention, since the anode electrodes are divided into the two groups or not divided, the anode lead electrodes can be flatly led out. Thus, it is not necessary to use a multilayer inter connection for the anode lead electrodes. Consequently, the structure of the anode base can be simplified.

Moreover, since the anode electrodes are divided into two groups or not divided, the duty of the apparatus becomes 3/2 times or three times as high as that of the conventional structure of which the anode electrodes are divided into three groups. Thus, the luminance of the display screen can be improved.

Furthermore, since the gate electrodes and anode electrodes are driven and scanned so that the electrons that are emitted are focused, a color image free of dullness can be obtained.

These and other objects, features and advantages of the present invention will become more apparent in light of the following detailed description of best mode embodiments thereof, as illustrated in the accompanying drawings.

BRIEF DESCRIPTION OF THE DRAWINGS

FIG. 3(*a*) is a sectional view showing the field emission type image display apparatus according to the first embodiment of the present invention;

FIG. 3(*b*) is a schematic diagram showing the relation among patch-shaped gate electrodes, gate lead electrodes, and cathode electrodes;

FIGS. 11(*a*) to 11(*n*) are timing charts of the driving method according to the first embodiment of the present invention;

FIGS. 12(*a*) to 12(*d*) are schematic diagrams showing states of which each pixel is selected by the driving method according to the first embodiment of the present invention;

FIGS. 17(*a*) to 17(*l*) are timing charts of the driving method according to the second embodiment of the present invention;

FIGS. 18(*a*) to 18(*d*) are schematic diagrams showing states of which each pixel is selected by the driving method according to the second embodiment of the present invention;

FIGS. 20(*a*) to 20(*i*) are timing charts of the driving method according to the modification of the second embodiment of the present invention;

FIG. 21(*a*) is a perspective view showing a structure of a conventional field emission type cathode;

FIG. 21(*b*) is a sectional view of FIG. 21(*a*);

DESCRIPTION OF THE PREFERRED EMBODIMENTS

Next, with reference to FIGS. 1(*a*) and 1(*c*), the structure of a field emission type device according to an embodiment of the present invention will be described.

Figure 1:
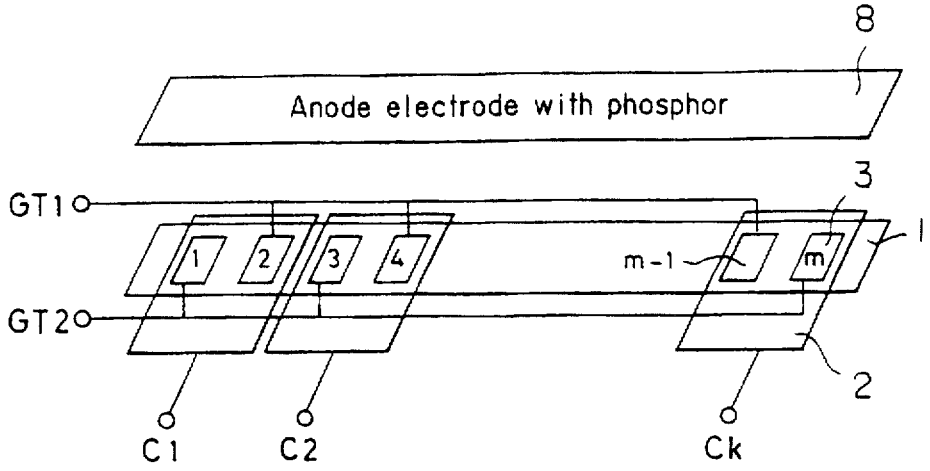
FIGS. 1(*a*), 1(*b*), and 1(*c*) are perspective views and a side view showing structures of field emission type devices according to an embodiment of the present invention and a modification thereof.
Figure 1:
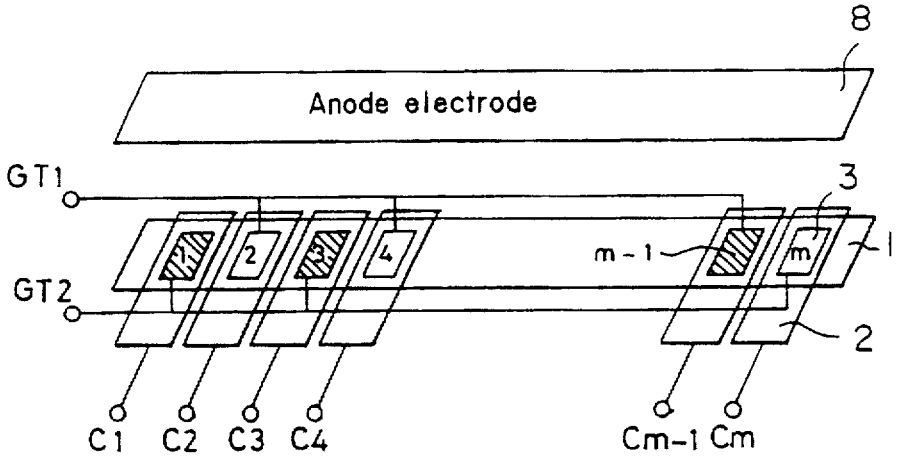
Figure 1:
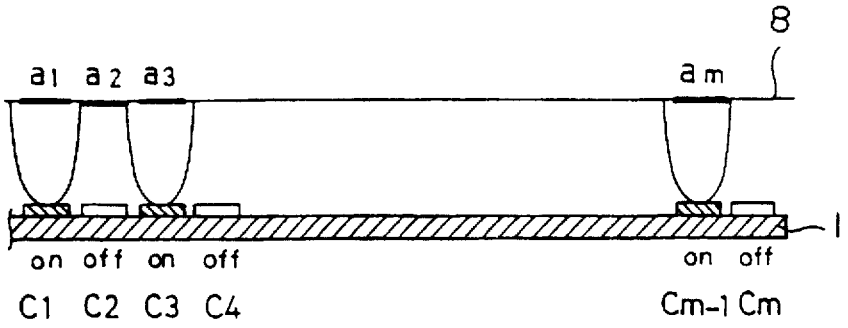

As shown in FIG. 1(*a*), in the structure of the field emission type device according to the embodiment of the present invention, a plurality of cathode electrodes 2 are disposed on a cathode base 1. Two patch-shaped gate electrodes 3 are formed on each cathode electrode 2 with an insulation. In this case, the patch-shaped gate electrodes 3 are formed on an insulation layer (not shown) disposed on the cathode electrode 2. Emitters that emit electrons are disposed at portions where the gate electrodes 3 overlap the cathode electrodes 2. The gate electrodes 3 and the insulation layer have holes through which electrons are emitted.

An array of the patch-shaped gate electrodes 3 is disposed in parallel. An anode electrode 8 is coated with phosphors. The anode electrode 8 is disposed opposite to the array of patch-shaped gate electrodes 3 so that the phosphors on the anode electrode 8 accord with the patch-shaped gate electrodes 3 in a one-to-one relation. Even-numbered patch-shaped gate electrodes 3 (2, 4, 6, 8, . . . , m-1) are connected to a first gate lead electrode GT1. Odd-numbered patch-shaped gate electrodes 3 (1, 3, 5, 7, . . . , m) are connected to a second gate lead electrode GT2.

Next, the driving method for the field emission type device in such a structure will be described. The first gate lead electrode GT1 and the second gate lead electrode GT2 are alternately driven. Image data of half of a line or the like is supplied to cathode lead electrodes C1, C2, C3, . . . , Ck that are led out of the cathode electrodes 2 at each driving timing of the gate lead electrodes. Thus, when the first gate lead electrode GT1 and then the second gate lead electrode G2 are driven, the phosphors on the anode electrode 8 light corresponding to the image data of one line supplied to the cathode lead electrodes C1, C2, C3, . . . , Ck.

In this case, the voltage of the gate lead electrode that is not driven is set to a low level, preferably to ground level.

When the anode electrode 8 is composed of a transparent electrode and rays of light transmitted through the anode electrode 8 are radiated to a photographic paper, the paper is exposed corresponding to the image data of one line. Thereafter, the photographic paper is advanced for one line. When the above-described field emission type device is lit and thereby the photographic paper is exposed, the image of the next line is obtained. By repeating these steps, an image for one page is exposed on the photographic paper. Thus, the field emission type device in FIG. 1(*a*) as well as in FIGS. 1(*b*) and 1(*c*) can be used as a light source for a printer or the like.

FIG. 1(*c*) shows the case where the second gate lead electrode GT2 is driven and the voltage of the first gate lead electrode GT1 is set to the low level. In this case, phosphors a1, a2, . . . , am are coated on the anode electrode 8 in a dot shape.

At this point, electrons are emitted from the odd-numbered patch-shaped gate electrodes 3 that are driven. Since the voltage of the even-numbered patch-shaped gate electrodes 3 adjacent to the odd-numbered patch-shaped gate electrodes 3 is set to the low level, the emitted electrons are focused when they reach the anode electrode 8. Thus, leakage of light emission from the adjacent dot-shaped phosphors can be prevented.

FIG. 1(*b*) shows a field emission type device according to a modification of the above-described embodiment. In this modification, cathode electrodes 2 are disposed corresponding to patch-shaped gate electrodes 3 in the one-to-one relation. In this case, although the number of cathode lead electrodes C1, C2, C3, . . . , Cm that are led out of the cathode electrodes is twice as many as the number of cathode lead electrodes of the FIG. 1(*a*) embodiment, it is not necessary to select image data supplied to the cathode lead electrodes C1, C2, C3, . . . , Cm corresponding to driving timings of the first gate lead electrode GT1 and the second gate lead electrode GR2. Thus, image data of one line can be supplied. However, it should be noted that image data may be supplied to only the odd-numbered cathode lead electrode or even-numbered cathode lead electrode C1, 2, C3, . . . , Cm disposed opposite to the driven patch-shaped gate electrode 3.

In the foregoing description, a line-type light source for use with an optical printer or the like was assumed. However, by dividing the anode electrode 8 corresponding to the cathode lead electrodes C1, C2, C3, . . . , Cm and connecting resistors to the divided portions of the anode electrode 8, a miniature vacuum tube that outputs modulated signals corresponding to input signals to the cathode electrodes 2 can be accomplished.

In this case, when the voltage of gate electrodes 3 adjacent to a selected gate electrode 3 is set to a low level, a lens effect works. Thus, the electron beam is focused and thereby a micron-size vacuum tube with an excellent S/N ratio can be accomplished.

Next, a field emission type image display apparatus according to an embodiment of the present invention will be described. In the embodiment, red, blue, and green colors of light are obtained by light emission of phosphors without using filters.

Figure 2:
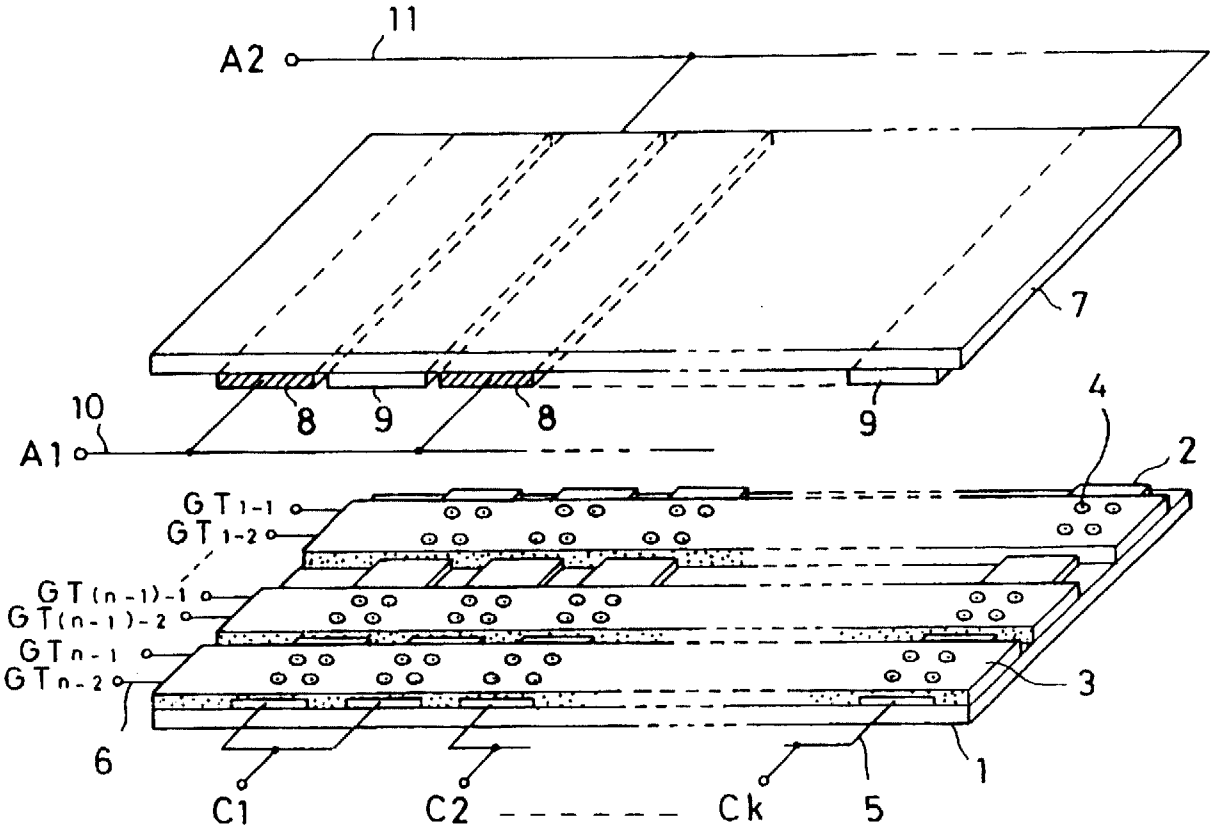
FIG. 2 is a perspective view showing a field emission type image display apparatus according to a first embodiment of the present invention.

FIG. 2 is a perspective view showing a structure of a field emission type image display apparatus according to a first embodiment of the present invention.

In FIG. 2, reference numeral 1 is a cathode base composed of glass or the like. An FEC array is disposed on the cathode base 1. Reference numeral 2 is a cathode electrode. A plurality of the cathode electrodes 2 are disposed in a stripe shape on the cathode base 1. Reference numeral 3 is a gate electrode. A plurality of the gate electrodes 3 are disposed on the cathode electrodes 2 through an insulation layer so that the gate electrodes 3 are disposed in perpendicular to the cathode electrodes 2. Reference numeral 4 is an electron emitting hole. A plurality of the electron emitting hole 4 are formed on the gate electrodes 3. In FIG. 2, although the gate electrodes 3 are illustrated in a stripe shape, they are actually formed in a patch shape at positions perpendicular to the cathode electrodes 2.

Reference numeral 5 is a cathode lead electrode that is led out of two adjacent cathode electrodes 2. A plurality of the cathode lead electrodes (Cl to Ck) are disposed. Reference numeral 6 is a gate lead electrode. A plurality of the gate lead electrodes 6 are disposed. The gate lead electrodes 6 are first gate lead electrodes GT1-2, GT2-2, . . . , GTn-2 connected to odd-numbered patch-shaped gate electrodes 3 and second gate lead electrodes GT1-1, GT2-1, . . . , GTn-1 connected to even-numbered patch-shaped gate electrodes 3. The first gate lead electrode GT1-2 and the second gate lead electrode GT1-1 are led out of both sides of the patch-shaped gate electrodes 3 of the line 1. The first gate lead electrode GT2-2 and the second gate lead electrode GT2-1 are led out of both sides of the patch-shaped gate electrodes 3 of the line 2. And so forth. Reference numeral 7 is an anode base. The anode base 7 is disposed opposite to the first base 1. Anode electrodes 8 are disposed on the anode base 7. Reference numeral 8 is a first anode electrode. A plurality of the first anode electrodes 8 are disposed in a stripe shape on the anode base 7. Reference numeral 9 is a second anode electrode. A plurality of the second anode electrodes 9 are disposed in a stripe shape on adjacent first anode electrodes 8. Reference numeral 10 is an anode lead electrode A1 connected to each of the first anode electrodes 8. Reference numeral 11 is an anode lead electrode A2 connected to each of the second anode electrodes 9. The anode electrodes 8 and 9 are disposed opposite to the cathode electrodes 2 in the one-to-one relation.

R, G, and B phosphors (not shown) are formed on the stripe-shaped anode electrodes 8 and 9 one after the other. The driving method for the image display apparatus shown in FIG. 2 will be briefly exemplified (the detail will be described later). Every second gate lead electrodes GT1-1 to GTn-2 of the gate electrodes 3 are scanned. Thus, every second patch-shaped gate electrodes 3 are driven. At this point, the anode electrodes 8 and 9 are driven corresponding to the driven patch-shaped gate electrodes 3. In other words, one of the anode lead electrodes A1 and A2 is selected and driven. In addition, image data is supplied to the cathode lead electrodes Cl to Ck.

First of all, the odd-numbered gate lead electrodes GT1-1 to GTn-1 are successively scanned. At this point, a positive anode voltage is applied to the anode lead electrode A1. In addition, image data of display pixels is supplied to the cathode lead electrodes Cl to Ck corresponding to the scanning timings.

Thus, the pixels of the phosphors disposed on the anode electrodes 8 are excited by electrons emitted from every second patch-shaped gate electrodes 3 that are selected and driven. The light emission of the pixels is controlled corresponding to image data supplied to the cathode lead electrodes Cl to Ck.

After all the gate lead electrodes GT1-1 to GTn-1 have been scanned, the positive anode voltage is applied to the anode lead electrode A2 instead of the anode lead electrode A1.

In this state, the even-numbered gate lead electrodes GT1-2 to GTn-2 are successively scanned. At this point, image data of display pixels is supplied to the cathode lead electrodes Cl to Ck corresponding to the scanning timings. Thus, the pixels of the phosphors disposed on the anode electrodes 9 are lit by electrons emitted from the rest of every second patch-shaped gate electrodes 3 connected to the scanned gate lead electrodes GT1-2 to GTn-2. The light emission of the pixels is controlled corresponding to the image data supplied to the cathode electrodes 2. Thus, one screen (one frame) of the image is displayed.

FIG. 3(*a*) is a sectional view showing the image display apparatus of the embodiment shown in FIG. 2. FIG. 3(*b*) is a schematic diagram showing the relation between the patch-shaped electrodes 3 and the gate lead electrodes GT1-1 to GTn-2.

In FIG. 3(*a*), reference numeral 1 is a cathode base on which cathode electrodes 2 and gate electrodes 3 are formed. Reference numeral 2 is one of the cathode electrodes. A plurality of the cathode electrodes 2 are disposed in a stripe shape on the cathode base 1. Reference numeral 3 is a patch-shaped gate electrode. A plurality of the patch-shaped gate electrodes 3 are disposed on the cathode electrodes 2 through an insulation layer (not shown) so that the patch-shaped gate electrodes 3 are disposed perpendicular to the cathode electrodes 2. Reference numeral 6 is an i-th gate lead electrode GTi that is led out of gate electrodes 3. Reference numeral 7 is an anode base disposed opposite to the first base 1. Anode electrodes are disposed on the anode base 7. Reference numeral 8 is a first anode electrode. A plurality of the first anode electrodes 8 are disposed in a stripe shape on the anode base 7. Reference numeral 9 is a second anode electrode. A plurality of the second anode electrodes 9 are disposed in a stripe shape. Each of the second anode electrodes 9 is disposed between adjacent first anode electrodes 8. Reference numeral 10 is an anode lead electrode A. The anode lead electrode A is connected to each of the first anode electrodes 8. Reference numeral 11 is an anode lead electrode A2. The anode lead electrode A2 is connected to each of the second anode electrodes 9.

Reference numeral 12 is a cone-shaped emitter. A plurality of the cone-shaped emitters 12 are disposed in an array shape on the corresponding cathode electrodes 2 by a microfabrication technology. Reference numeral 13 is a spacer for separately supporting the cathode base 1 and the anode base 7 with a predetermined distance therebetween. An outer member of the image display apparatus is composed of the cathode base 1, the anode base 7, and the spacer 13. The inside of the outer member is highly evacuated.

In the image display apparatus shown in FIG. 3(*a*), stripe-shaped cathode electrodes 2 are disposed corresponding to the anode electrodes 8 and 9 in the one-to-one relation.

As shown in FIG. 3(*b*), the patch-shaped gate electrodes 3 are divided in rectangular portions as pixels. Every second patch-shaped gate electrodes 3 of each line are connected to gate lead electrodes. The two gate lead electrodes disposed on each line are led out of both sides of the patch-shaped gate electrodes 3. In other words, odd-numbered patch-shaped gate electrodes (G, B, R, . . .) of the line 1 are connected to the first gate lead electrode GT1-1. The remaining even-numbered patch-shaped gate electrodes 3 (R, G, B, . . . ) are connected to the second gate lead electrodes GT1-2. Likewise, every second patch-shaped gate electrodes 3 of each line are connected to the first gate lead electrodes and the second gate lead electrodes.

Figure 4:
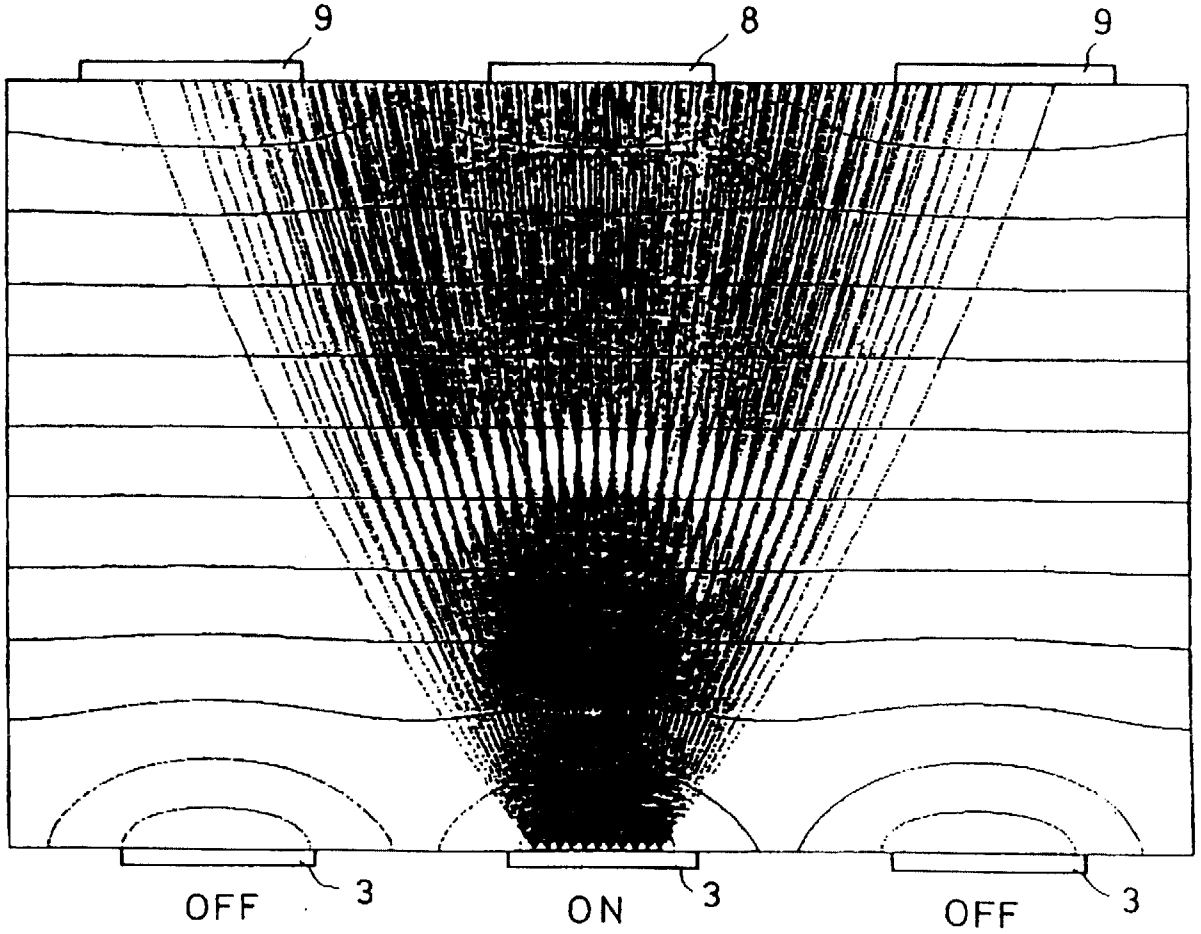
FIG. 4 is a graph showing a distribution of electrons emitted from a cathode electrode.

FIG. 4 shows an example of a simulation result of a distribution of electrodes emitted to the anode electrodes 8 and 9. In this case, the voltage of the anode electrode 8 is the same as the voltage of the anode electrodes 9. On the other hand, as with the conventional structure, the voltages of all the stripe-shaped gate electrodes 3 of each line are the same.

Electrons are emitted from the array of the emitters 12 with an angle of around 30 degrees as a half angle. Thus, as shown in FIG. 4, since the electrons that are emitted from the top portions of the gate electrodes 3 to the anode electrode 8 and the adjacent anode electrodes 9 largely spread, leakage of light emission takes place.

Figure 5:
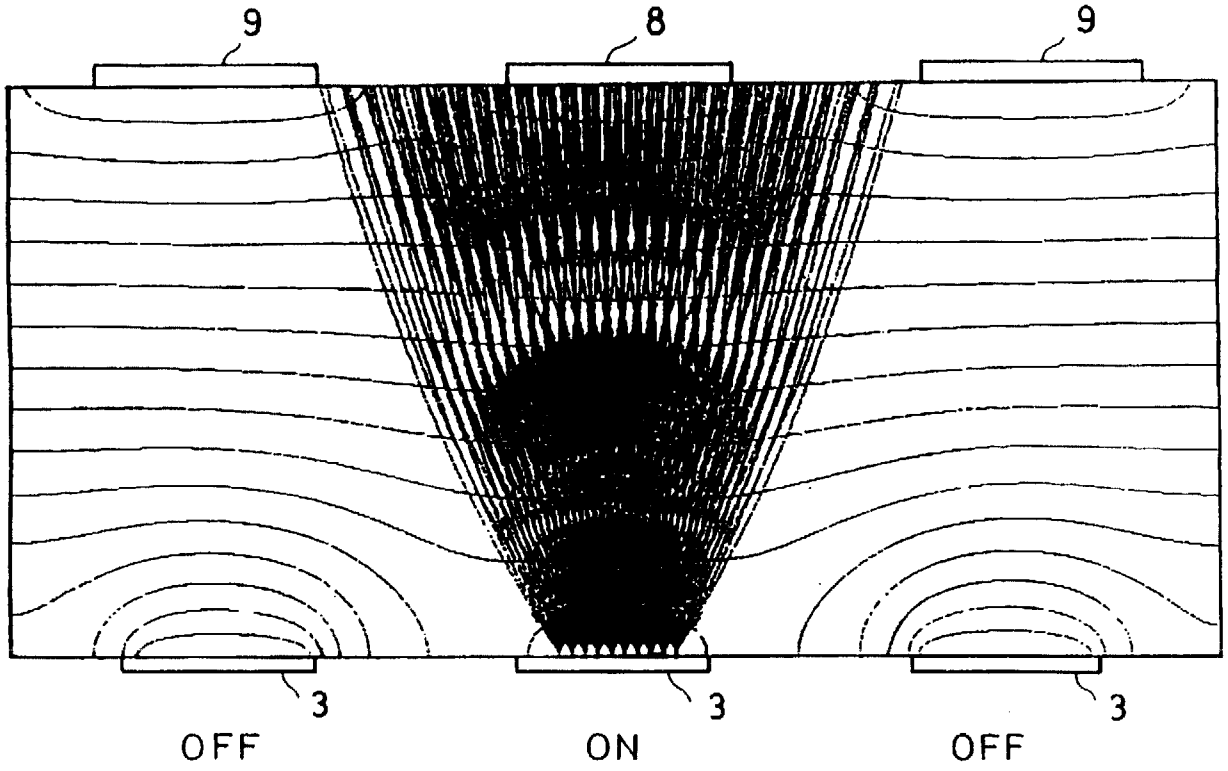
FIG. 5 is a graph showing a distribution of electrons emitted from a cathode electrode in the case where the distance between gate electrodes and anode electrodes is small.

FIG. 5 shows an example of a simulation result of a distribution of electrons in the case where voltages are applied to the anode electrodes 8 and 9 and the gate electrodes in the same manner as shown in FIG. 4 and the distance between each of the anode electrodes 8 and 9 and the gate electrodes 3 is ¾ of that shown in FIG. 4. In this case, since the spreading of the electrons is reduced corresponding to the distance between each of the anode electrodes 8 and 9 and the gate electrode 3, the electrons hardly reach the adjacent anode electrodes 9.

Figure 6:
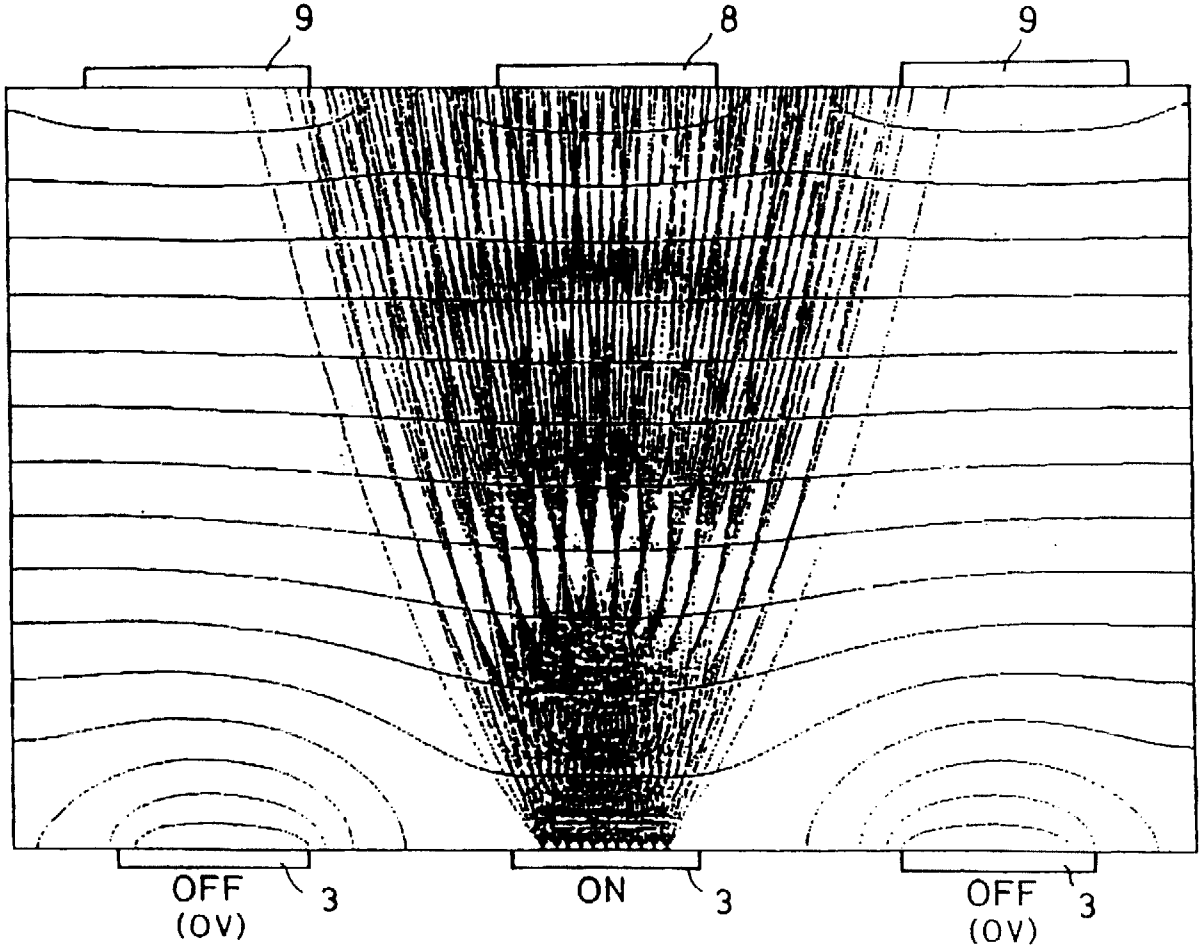
FIG. 6 is a graph showing a distribution of electrons emitted from a cathode electrode in the case where the voltages of gate electrodes that are not driven are set to ground level.

FIG. 6 shows an example of a simulation result of a distribution of electrons in the case where the voltages of the anode electrode 8 and the anode electrodes 9 are the same and the voltages of gate electrodes 3 that are turned off and that are disposed adjacent to a gate electrode 3 that is turned on are set to ground level (0). In this case, the spreading of the electrons is narrower than that shown in FIG. 4.

Figure 7:
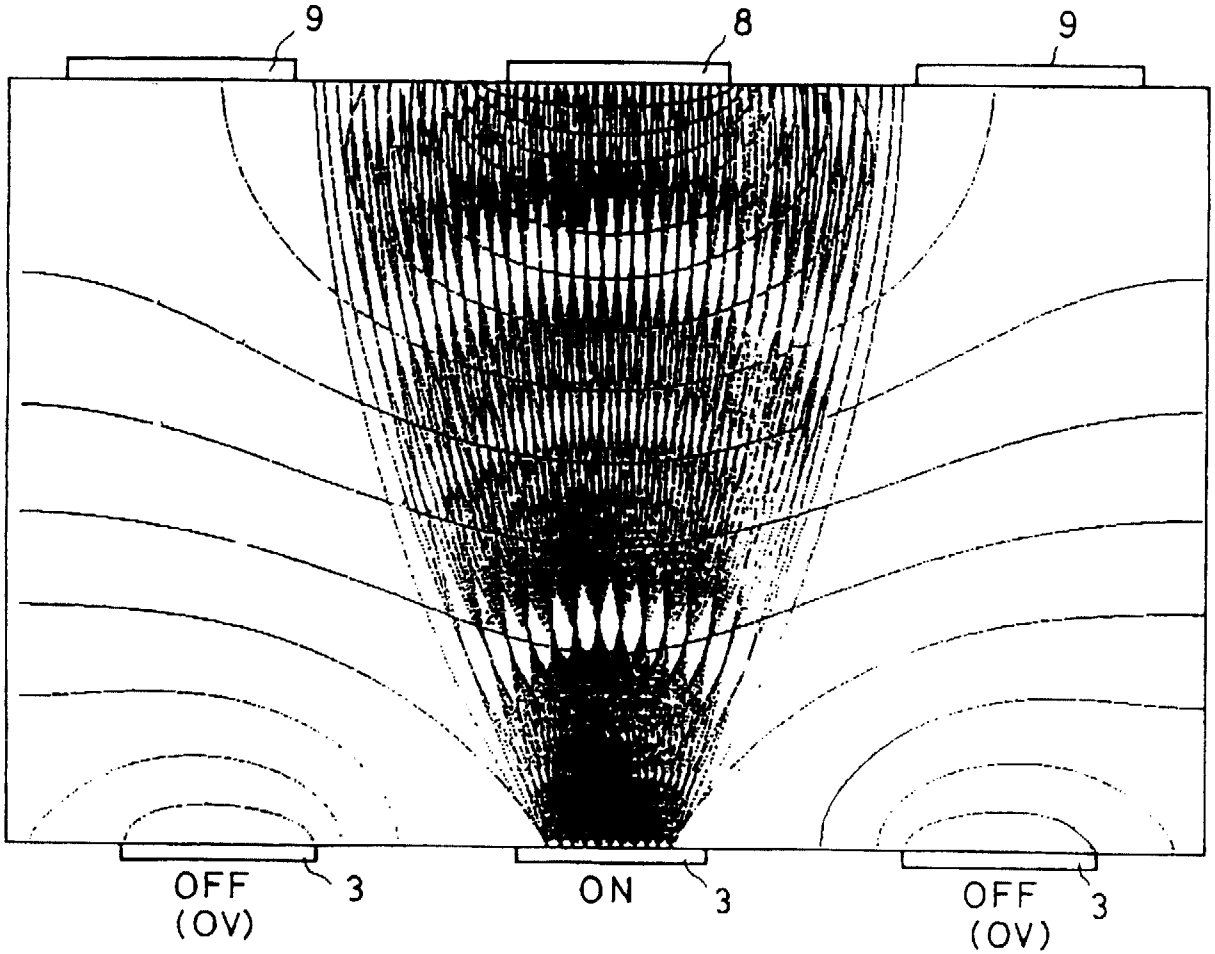
FIG. 7 is a graph showing a distribution of electrons emitted from a cathode electrode in the case where the voltage of anode electrodes that are not driven is half of the voltage of an anode electrode that is driven.

FIG. 7 shows an example of a simulation result of a distribution of electrons in the case where the voltage of anode electrodes 9 that are turned off is around half of the voltage of an anode electrodes 8 that is turned on and the voltage of gate electrodes 3 that are turned off and that are disposed adjacent to a gate electrode 3 that is turned on is set to ground level. In this case, the spreading of the electrons is further narrowed.

Figure 8:
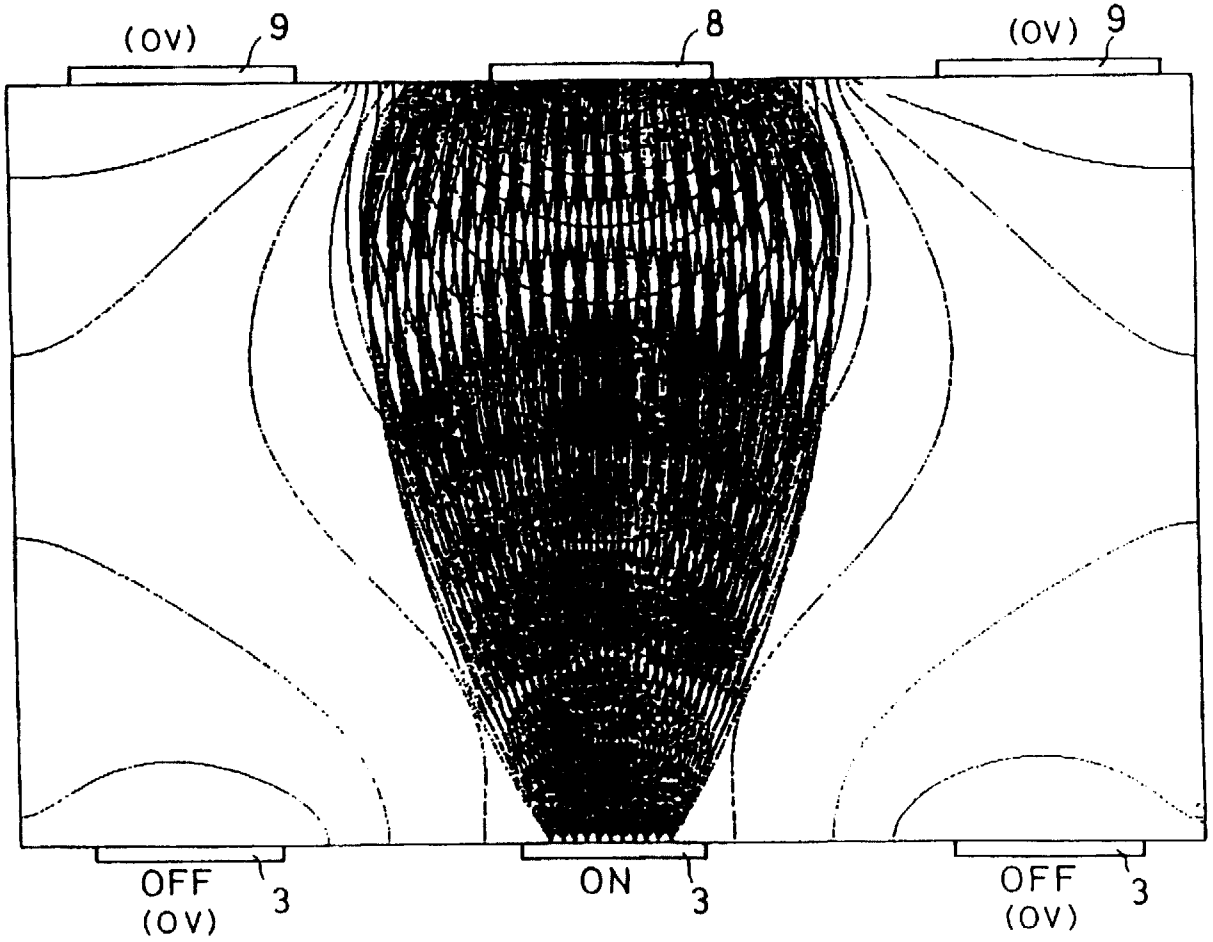
FIG. 8 is a graph showing a distribution of electrons emitted from a cathode electrode in the case where the voltage of anode electrodes that are not driven is set to ground level.

FIG. 8 shows an example of a simulation result of a distribution of electrons in the case where the voltage of anode electrodes 9 that are turned off is set to ground level and the voltage of gate electrodes 3 that are turned off and that are disposed adjacent to a gate electrode 3 that is turned on is set to ground level. In this case, the spreading of the electrons is narrowed so that they reach only the anode electrode 8.

With reference to FIGS. 4 to 8, when the anode electrodes 8 and 9 and the gate electrodes 3 are disposed and driven as shown in FIGS. 5 to 8, as much leakage of light emission as possible can be prevented. Thus, only a phosphor coated on an anode electrode 9 can be lit.

Figure 9:
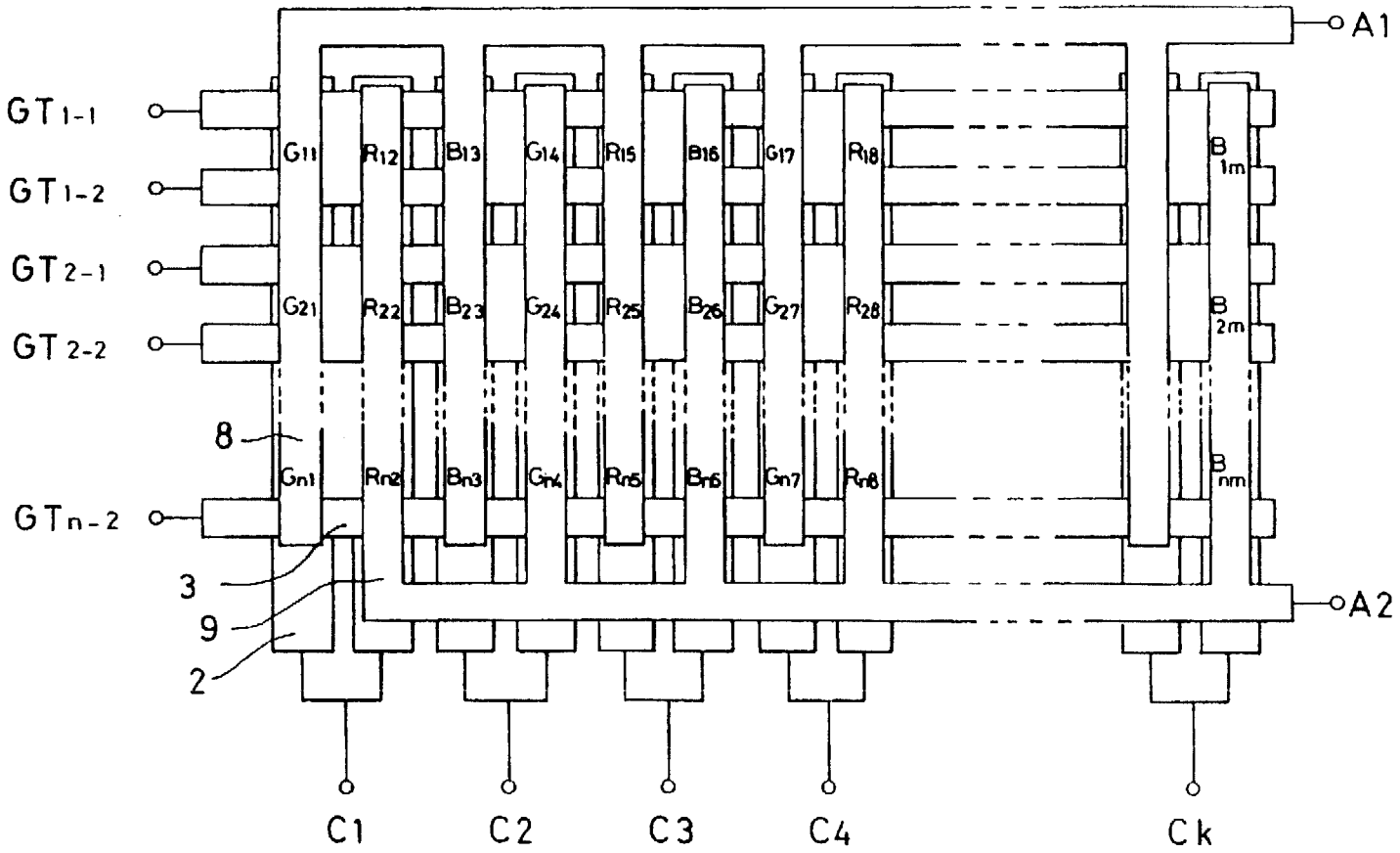
FIG. 9 is a schematic diagram showing an example of an arrangement of electrodes of the field emission type image display apparatus according to the first embodiment of the present invention.
Figure 10:
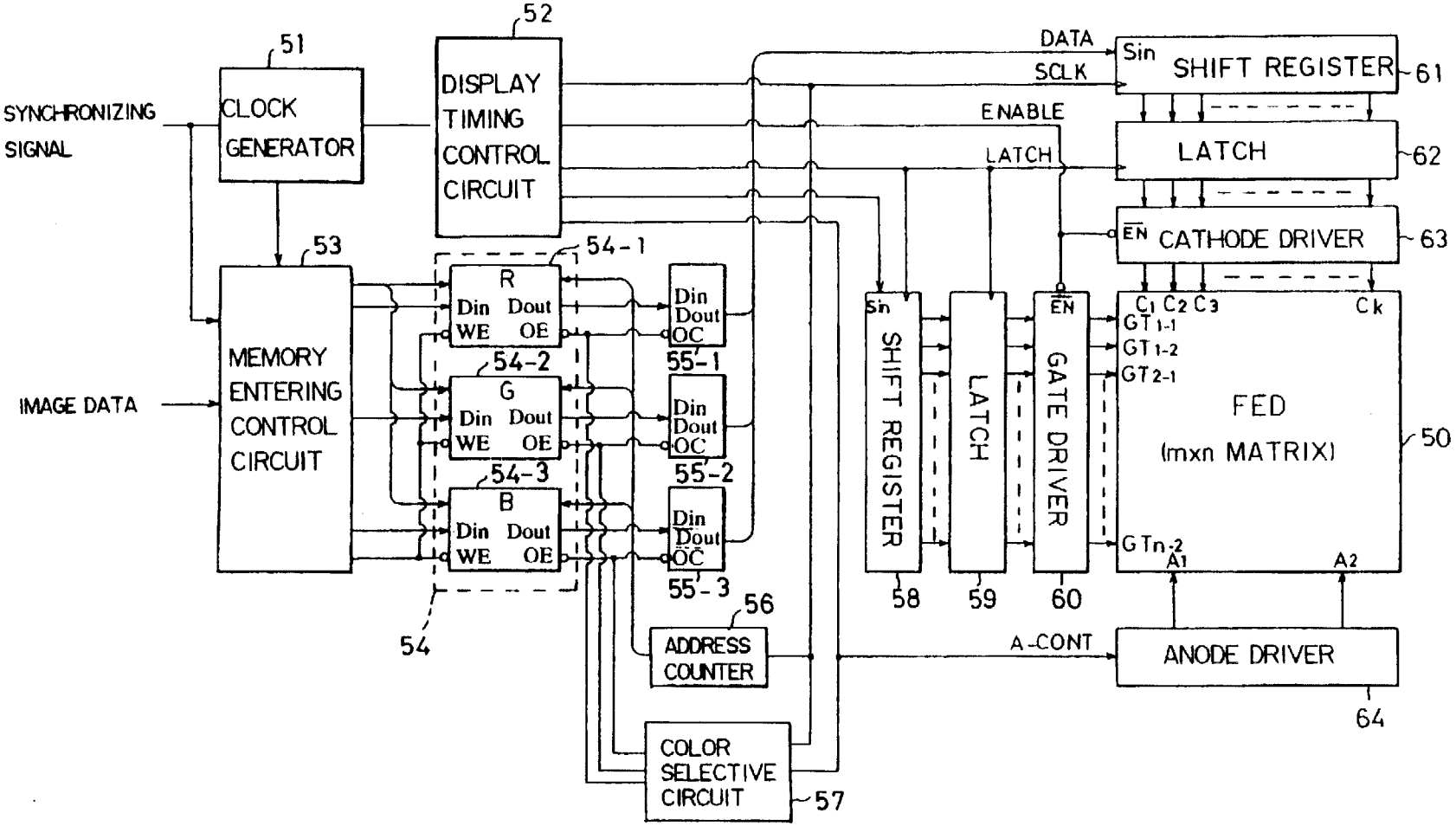
FIG. 10 is a block diagram showing a driving circuit for explaining a driving method according to the first embodiment of the present invention.

FIG. 10 is a block diagram showing a structure of a driving circuit that embodies the driving method of the field emission type image display apparatus according to the present invention. The driving circuit can drive the field emission image display apparatus so that it can properly focus electrons as shown in FIG. 8. FIG. 9 shows an arrangement of electrodes viewed from the anode electrode side of the image display apparatus.

In FIG. 9, anode electrodes 8 and 9 are connected to anode lead electrodes A1 and A2 and led out of both sides. Cathode electrodes 2 are disposed opposite to the anode electrodes 8 and 9 in parallel therewith. The cathode electrodes 2 are spaced apart from the anode electrodes 8 and 9. Every two adjacent cathode electrodes 2 are connected and led out as cathode lead electrodes Cl to Ck.

Patch-shaped gate electrodes 3 are disposed on the cathode electrodes 2 with an insulation in the line direction perpendicular to the anode electrodes 8 and 9. As shown in FIG. 3(*b*), gate lead electrodes GT1-1, GT1-2, . . . . GTn-2 that are connected to every second patch-shaped gate electrodes 3 are led out of one side or two sides. The patch-shaped gate electrodes 3 have holes through which electrons are emitted from the array of the emitters.

In addition, G, R, and B phosphors are alternately coated on the anode electrodes 8 and 9 from the left electrode. Pixel are composed of portions of which the anode electrodes 8 and 9 and the cathode electrodes 2 intersect each other. Line 1 is composed of pixels G11, R12, B13, G14, R15, B16, . . . . B1m. Line 2 is composed of pixels G21, R22, B23, . . . . B2m. The last line is composed of Gn1, Rn2, Bn3, . . . . Bnm.

Thus, the pixels G11 to Bnm disposed at the anode electrodes 8 and 9 are formed in a matrix shape. The patch-shaped gate electrodes 3 are disposed opposite to these pixels. These pixels are selected and driven by scanning the anode lead electrodes A1 and A2 and the gate lead electrodes GT1-1 to GTn-2.

FIG. 10 is a block diagram showing the driving circuit that drives the pixels in the above-described manner. FIGS. 11(*a*) to 11(*n*) are timing charts for the driving circuit. FIGS. 12(*a*) to 12(*d*) show states of which the pixels are lit.

In FIG. 10, reference numeral 50 is a field emission type image display apparatus that has field emission cathodes composed of a matrix of m×n pixels. Reference numeral 51 is a clock generator that generates a clock in synchronization with a synchronous signal that is received. Reference numeral 52 is a display timing controlling circuit that controls a display timing with the clock generated by the clock generator 51. Reference numeral 53 is a memory write controlling circuit that controls the writing of input image data to a video memory 54. The video memory 54 is composed of a frame memory or line memories 54-1, 54-2, and 54-3. Reference numerals 55-1, 55-2, and 55-3 are buffer registers that store R, G, and B image data read from the video memory 54.

Reference numeral 56 is an address counter that generates an address of the video memory 54. Reference numeral 57 is a color selecting circuit that selects one of R, G, and B image data. Reference numeral 58 is a shift register that shifts data for controlling the gate electrodes 3. Reference numeral 59 is a latch circuit that latches data of the shift register 58. Reference numeral 60 is a gate driver that drives the gate electrodes corresponding to data of the latch circuit 59. Reference numeral 61 is a shift register that shifts image data received from the buffer registers 55-1 to 55-3 corresponding to the shift clock. Reference numeral 62 is a latch circuit that latches data of the shift register 61. Reference numeral 63 is a cathode driver that supplies image data that is output from the latch circuit 62 to the cathode electrodes.

FIG. 11(*a*) shows output pulses of an anode driver 64 that drives the anode lead electrode A2. FIG. 11(*b*) shows output pulses of the anode driver 64 that drives the anode lead electrode A1. FIG. 11(*c*) shows output pulses of the gate driver 60 that drives the gate lead electrode GT1-1. FIG. 11(*d*) shows output pulses of the gate driver 60 that drives the gate lead electrode GT2-1. FIG. 11(*e*) shows output pulses of the gate driver 60 that drives the gate lead electrode GTn-1. FIG. 11(*f*) shows output pulses of the gate driver 60 that drives the gate lead electrode GT1-2. FIG. 11(*g*) shows output pulses of the gate driver 60 that drives the gate lead electrode GT2-2. FIG. 11(*h*) shows output pulses of the gate driver 60 that drives the gate lead electrode GTn-2.

FIG. 11(*i*) shows image data that is supplied from the cathode driver 63 to the cathode lead electrode Cl. FIG. 11(*j*) shows image data that is supplied from the cathode driver 63 to the cathode lead electrode C2. FIG. 11(*k*) shows image data that is supplied from the cathode driver 63 to the cathode lead electrode C3. FIG. 11(*l*) shows latch pulses that represent latch timings of the latch circuits 59 and 62. FIG. 11(*m*) shows a shift clock supplied to the shift register 61. FIG. 11(*n*) shows image data that is supplied from the buffer registers 55-1, 55-2, and 55-3 to the shift register 61 in display order.

Next, with reference to the timing charts shown in FIGS. 11(*a*) to 11(*n*), the operation of the driving circuit shown in FIG. 10 will be described.

The write timing of the image data is controlled by the memory write controlling circuit 53. In addition, image data of each color is stored in the video memory 54 in synchronization with the clock generated by the clock generator 51. The R, G, and B image data is stored in the memories 54-1, 54-2, and 54-3 of the video memory 54. The image data is read from the memories 54-1, 54-2, and 54-3 corresponding to the address of the address counter 56 under the control of the color selecting circuit 57 and stored in the buffer registers 55-1, 55-2, and 55-3, respectively.

Output timings of the buffer registers 55-1, 55-2, and 55-3 are controlled by the color selecting circuit 57. Each of image data is supplied to the shift register circuit 61 in the same display order of the G, B, and R pixels shown in FIG. 12. The shift register 61 shifts the image corresponding to the shift clock S-CLK shown in FIG. 11(*m*).

When color data for a half line of pixels corresponding to the number of the stripe-shaped electrodes connected to the anode lead electrode A1 is shifted by the shift register 61, the color data is latched by the latch circuit 62 corresponding to the latch pulses shown in FIG. 11(*l*). The output data of the latch circuit 62 is supplied to the cathode driver 63.

On the other hand, the display control timing circuit 52 controls the anode driver 64 and supplies a positive anode voltage to only the anode lead electrode A1 as shown in FIGS. 11(*a*) and 11(*b*). (In this case, an anode voltage that is half of the anode voltage supplied to the anode lead electrode A1 may be applied to the anode lead electrode A2.)

In addition, the display timing controlling circuit 52 supplies the latch pulses shown in FIG. 11(*l*) as shift pulses to the shift register 58 so that the shift register 58 shifts the scan signal received from the display timing controlling circuit 52. The output data of the shift register 58 is latched by the latch circuit 59 corresponding to the latch pulses. Thus, the latch circuit 59 outputs the scan signal that is shifted upon occurrence of the latch pulse. The scan signal is supplied to the gate driver 60.

Thus, as shown in FIGS. 11(*c*), 11(*d*), and 11(*e*), the gate driver 60 successively supplies the gate drive voltage to the gate lead electrodes GT1-1, GT2-1, . . . . GTn-1. Consequently, the gate lead electrodes GT1-1, GT2-1, . . . . GTn-1 are scanned at the timings of the latch pulses.

At this point, the image data shown in FIGS. 9(*i*), 9(*j*), 9(*k*), . . . are supplied from the cathode driver 63 to the cathode lead electrodes C1, C2, C3, . . . in synchronization with the scanning of the cathode lead electrodes C1 to Ck. In the case that the gate lead electrode GT1-1 is driven, when the anode voltage is supplied to the anode lead electrode A1, the G, B, and R image data shown in FIGS. 11(*i*), 11(*j*), and 11(*k*) is supplied to the cathode lead electrodes C1, C2, C3, . . . , respectively.

Thus, the light emissions of the odd-numbered pixels G11, B13, R15, . . . of the line 1 are controlled as shown in FIG. 12. In this case, the voltage of the gate electrode GT1-2 connected to the even-numbered pixels R12, G14, B16, . . . of the line 1 that are not driven is set to the ground level.

Thus, as shown in FIG. 12(*a*), the light emissions for the half of pixels of the line 1 of the image display apparatus 50 are controlled. The emitted electrons are focused and reached to the anode electrode 8.

When the gate lead electrode GT2-1 is selected and driven at the timing of the next latch pulse, since the image data of the line 2 is shifted by the shift register 61 corresponding to the shift clock S-CLK, the light emissions for the half of pixels of the line 2 are controlled as shown in FIG. 12(*b*).

After the gate lead electrode GTn-1 of the last line has been scanned, the light emissions for half of the pixels of one frame have been controlled.

Thereafter, the display timing controlling circuit 52 controls the anode driver 64 so that a positive anode voltage is applied to the anode lead electrode A2. (In this case, an anode voltage that is around ½ or less of the anode voltage applied to the anode electrode A2 may be supplied to the anode electrode A1.)

When the anode voltage is applied to the anode lead electrode A2, as shown in FIG. 11, the gate lead electrodes GT1-2 to GTn-2 are selected and driven. In addition, R, G, B, . . . image data is supplied to the cathode electrodes C1, C2, C3, . . . , respectively. The voltages of the gate lead electrodes GT1-1 to GTn-1 that are not selectively driven are set to the ground level.

In the above-described manner, by scanning the gate lead electrodes GT1-2 to GTn-2, the light emissions for the remaining pixels of the frame are successively controlled as shown in FIGS. 12(*c*) and 12(*d*). After the gate lead electrode GTn-2 of the last line has been scanned, the image of the frame is displayed on the image display apparatus 50.

According to the above-described driving circuit, the number of selecting operations for the anode lead electrodes to which high voltages are applied is only two per frame. Thus, the structure of the driving circuit of the anode lead electrodes can be simplified.

In addition, since the voltage of adjacent gate electrodes that are not selectively driven is set to the ground level, the emitted electrons are focused and thereby prevents colors from being mixed. In addition, when the voltage of the anode electrodes 8 and 9 that are not driven is lowered, the emitted electrons can be more focused. When the voltage of the anode electrodes 9 that are not driven is ½ or less of the voltage of the anode electrode 8 that is driven, the emitted electrons are preferably focused as shown in FIGS. 7 and 8.

As shown in FIG. 3(*b*), the first gate lead electrode and the second gate lead electrode are led out of both sides of the patch-shaped gate electrode 3. However, it should be noted that the first gate lead electrode and the second gate lead electrode can be led out of one side of the patch-shaped gate electrodes 3 with a multilayer inter connection.

In the first embodiment shown in FIG. 9, every adjacent two cathode electrodes 2 are connected. However, such connections may be made inside or outside a display tube.

In addition, the cathode electrodes 2 may be formed as pairs thereof.

Instead of driving all second cathode electrodes 2 disposed corresponding to the anode electrodes 8 and 9 in the one-to-one relation, the cathode electrodes 2 may be individually driven.

Instead of alternately scanning groups of the odd-numbered gate lead electrodes and the even-numbered gate lead electrodes, the gate lead electrodes GT1-1, GT1-2, . . . , GTn-1, GTn may be successively scanned so as to alternately drive the anode lead electrodes A1 and A2 at the timings.

Figure 13:
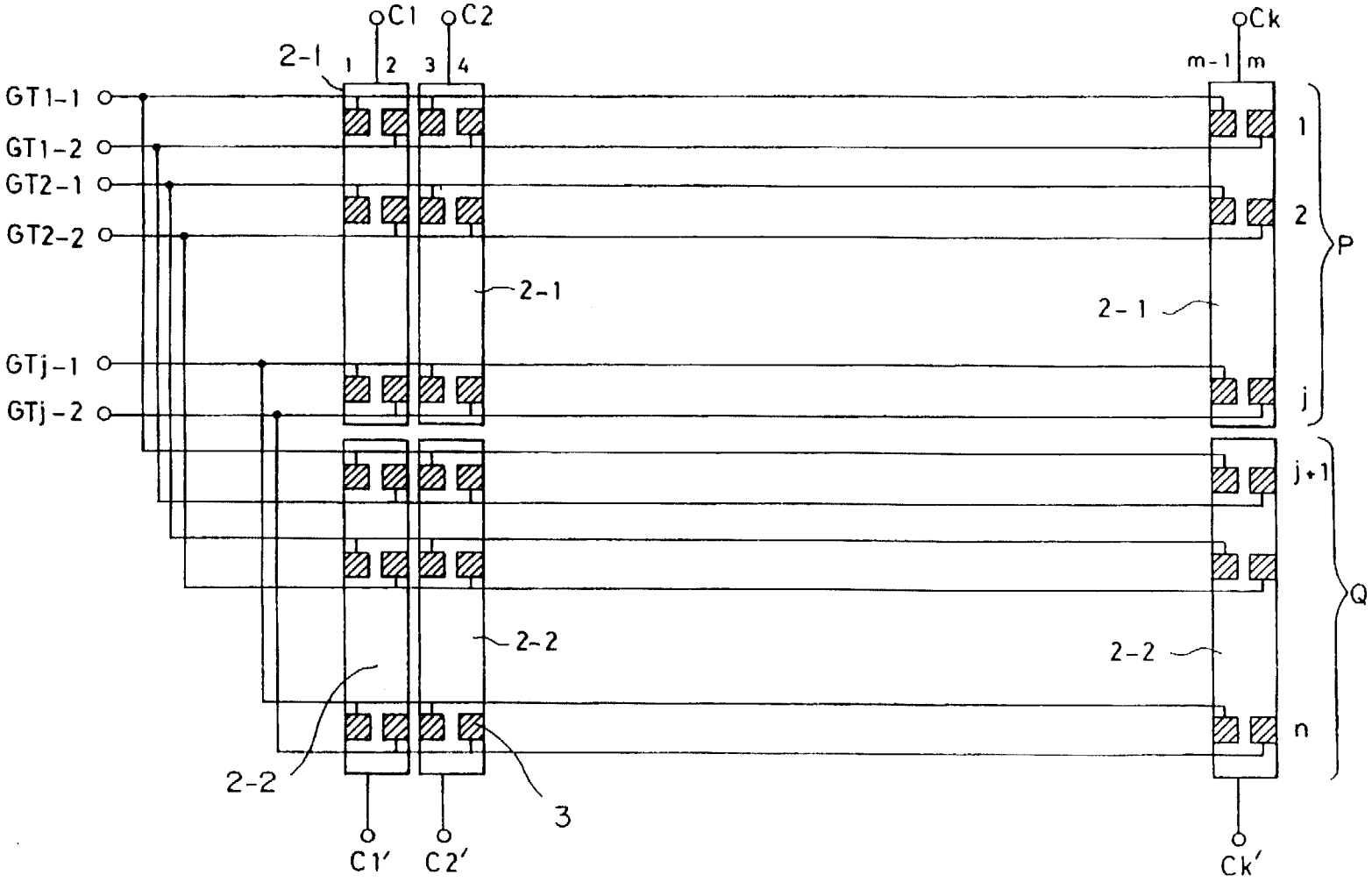
FIG. 13 is a schematic diagram showing a structure of a modification of the first embodiment of the present invention.

FIG. 13 shows a modification of the field emission type image display apparatus according to the first embodiment of the present invention. In this modification, the cathode electrodes are divided into two groups in the line direction. In FIG. 13, anode electrodes are omitted.

In FIG. 13, cathode electrodes are divided into a first group P composed of first cathode electrodes 2-1 and a second group Q composed of second cathode electrodes 2-2. Pairs of patch-shaped gate electrodes are formed on each of the cathode electrodes 2-1 and 2-2 in the line direction through an insulation layer (not shown). The first group P includes n/2 patch-shaped electrodes 3 (1, 2, 3, . . . , j) disposed in the row direction. The second group Q includes n/2 patch-shaped electrodes 3 (j+1, j+2, j+3, . . . , n) in the row direction.

Lead electrodes that are led out of the first group P on each line are connected to lead electrodes that are led out of the second group Q on the corresponding line. In other words, the odd-numbered patch-shaped gate electrodes 3 (1, 3, 5, 7, . . . , m-1) of the line 1 of the first group P and the second group Q are connected in common to a first gate lead electrode GT1-1. The even-numbered gate electrodes 3 (2, 4, 6, 8, . . . , m) of the line 1 of the first group P and the second group Q are connected in common to a second gate lead electrode GT1-2. This is also applicable to first lead electrodes GT2-1, . . . , GTj-1 and second gate lead electrode GT2-2, . . . , GTj-2 of the line 2 or later.

In this modification, although the image display apparatus is driven in the same manner as the first embodiment, since the number of gate lead electrodes is half of that of the first embodiment, the number of gate drivers is also half of that of the first embodiment. In addition, k cathode lead electrodes C1, C2, . . . , Ck are led out of the first group P and k cathode lead electrodes C1', C2', . . . , Ck' are led out of the second group Q. In this embodiment, whenever each of the gate lead electrodes is scanned, every second patch-shaped gate electrode 3 of every two lines are driven so that corresponding image data is supplied to the cathode lead electrodes of the two groups.

Thus, an image of one frame can be displayed on the anode base disposed opposite to the patch-shaped gate electrodes 3 with half the number of scanning times of the first embodiment. Consequently, the duty of the apparatus becomes twice of the first embodiment.

Figure 14:
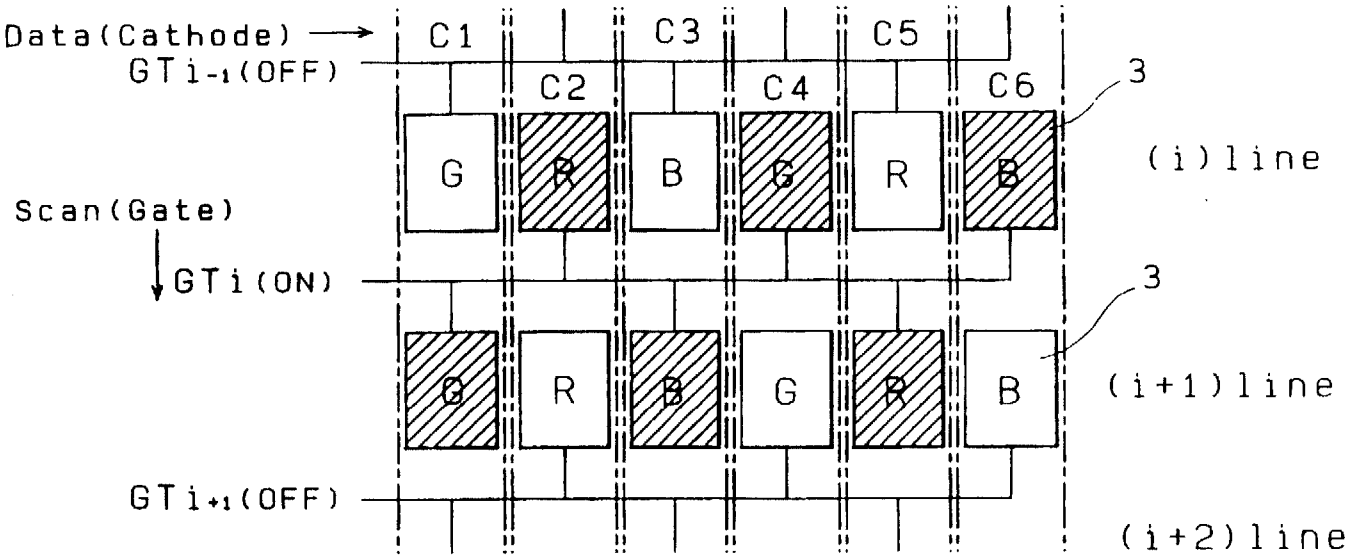
FIG. 14 is a schematic diagram showing the relation among patch-shaped gate electrodes, gate lead electrodes, and cathode electrodes of a field emission type image display apparatus according to a second embodiment of the present invention.

FIG. 14 shows the relation between patch-shaped gate electrodes 3 and gate lead electrodes GT1-1 to GTn-2 of a field emission type image display apparatus according to a second embodiment of the present invention. The sectional view of the field emission type image display apparatus of the second embodiment is nearly the same as that shown in FIG. 3(*a*). However, in the second embodiment, the anode electrode is not divided into two portion, but formed as one plane portion.

Next, with reference to FIG. 14, the connections of the patch-shaped gate electrodes 3 and the gate lead electrodes will be described. Patch-shaped gate electrodes 3 corresponding to odd-numbered G, B, and R pixels of a line (i) are connected to a gate lead electrode GTi-1. The rest of the patch-shaped gate electrodes 3 corresponding to the even-numbered R, G, and B pixels of the line (i) are connected to a gate lead electrode GTi.

Patch-shaped gate electrodes 3 corresponding to the odd-numbered G, B, and R pixels of a line (i+1) are connected to the gate lead electrode GTi. The rest of the patch-shaped gate electrodes 3 corresponding to the even-numbered R, G, and B pixels of the line (i−1) are connected to the gate lead electrode GTi−1. Likewise, every second patch-shaped gate electrodes 3 of the vertically adjacent lines are connected to each of the gate lead electrodes GT1 to GTn.

Although these gate lead electrodes GT1 to GTn are successively scanned and driven, when the gate lead electrode GTi is driven, the even-numbered R, G, and B pixels of the line (i) and the odd-numbered G, B, and R pixels of the line (i+1) that are hatched are driven.

At this point, when image data is supplied to the cathode electrodes C1, C2, . . . , Cm disposed corresponding to the patch-shaped gate electrodes 3 in the one-to-one relation, the image can be displayed on the anode base.

When the voltages of the gate lead electrode GTi−1 and the gate lead electrode GTi−1 that are not driven are set to ground level, the voltages of the patch-shaped gate electrodes 3 disposed horizontally adjacent to the patch-shaped gate electrodes 3 that are hatched become ground level. Thus, as described above, electrons emitted through the gate electrodes can be focused.

Figure 15:
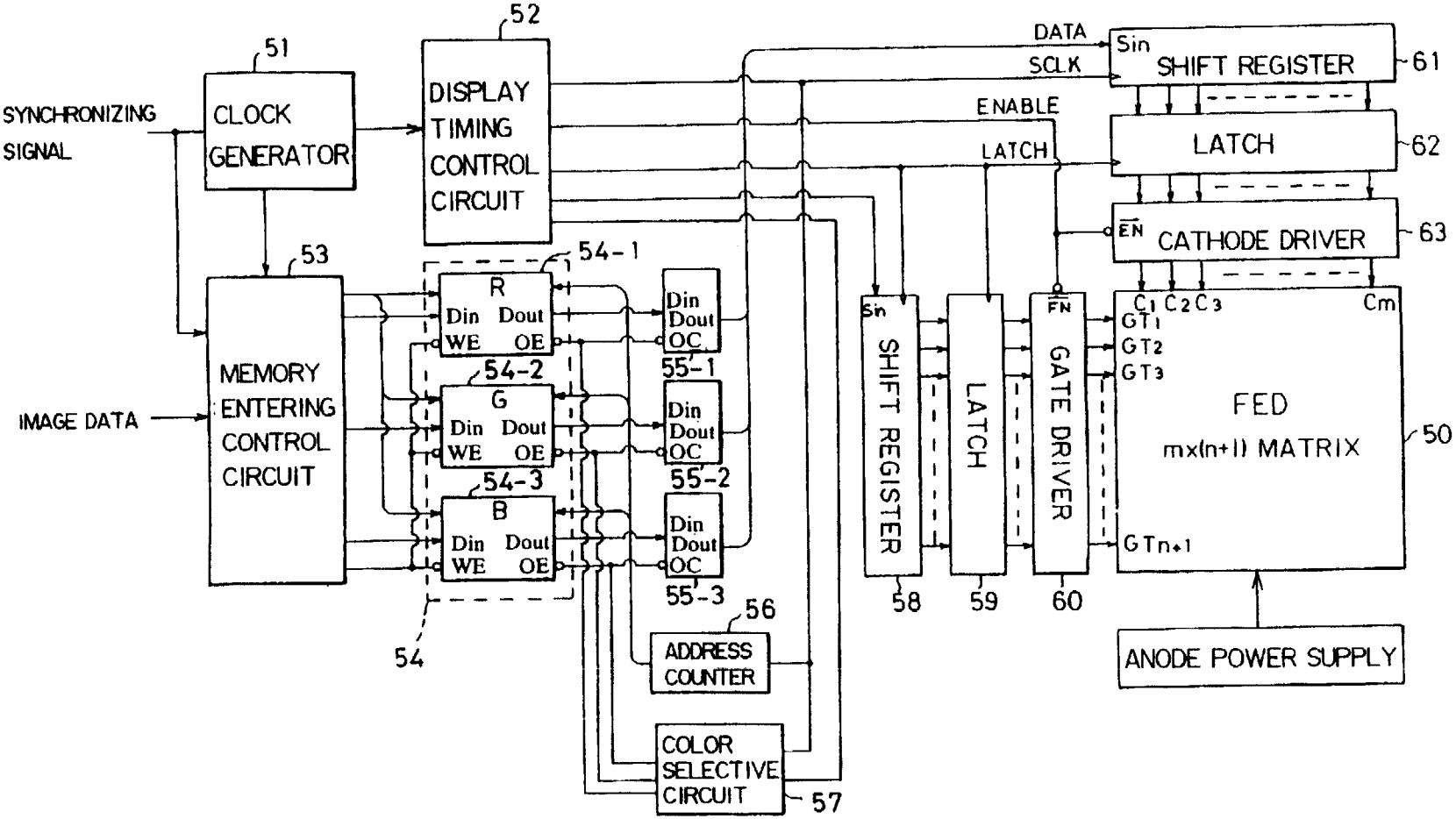
FIG. 15 is a block diagram showing a driving circuit for explaining a driving method according to the second embodiment of the present invention.
Figure 16:
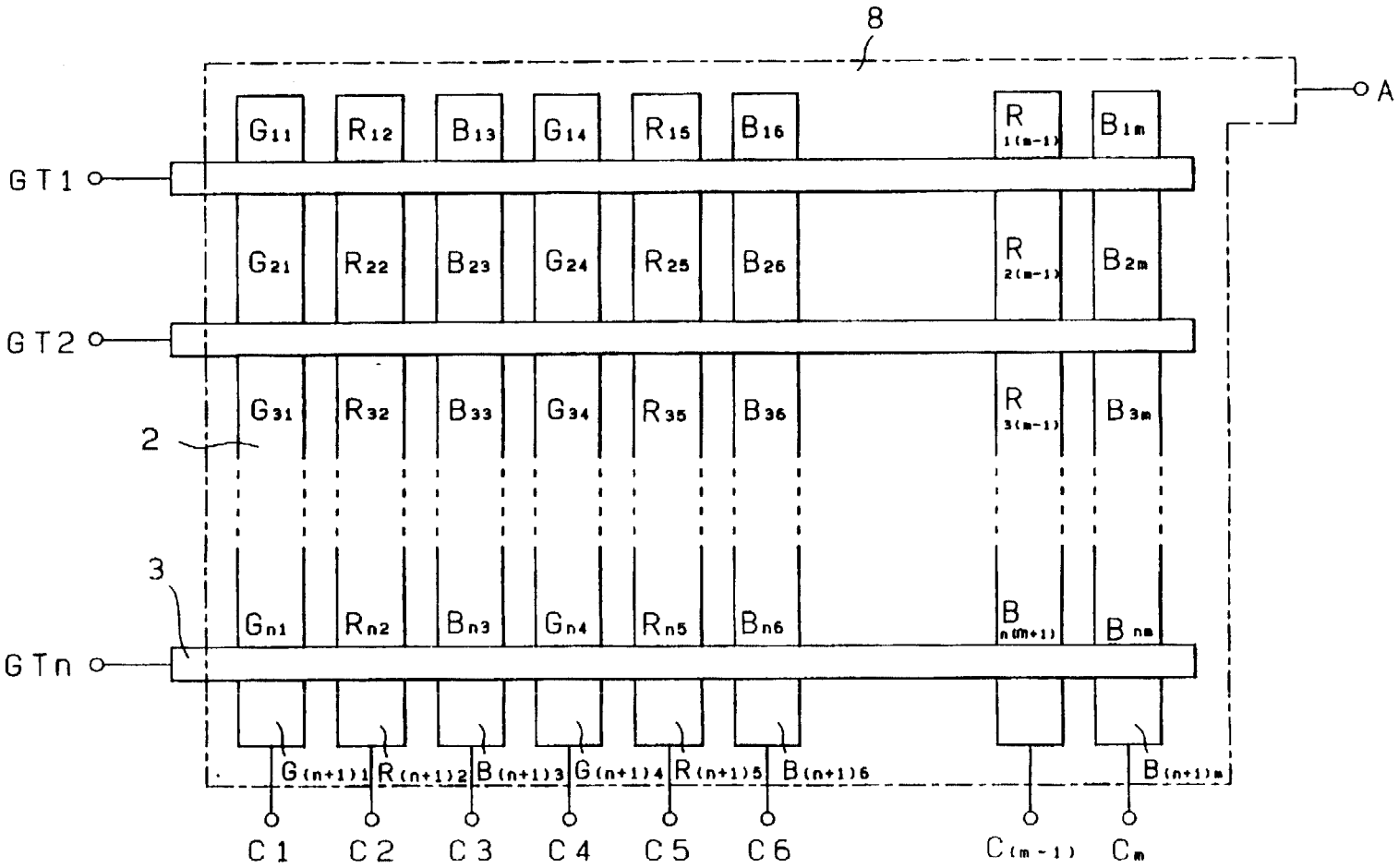
FIG. 16 is a schematic diagram showing an example of an arrangement of electrodes of the field emission type image display apparatus according to the second embodiment of the present invention.

FIG. 15 is a block diagram showing a structure of a driving circuit embodying a driving method according to the second embodiment of the present invention. FIG. 16 shows the arrangement of electrodes viewed from the anode electrode side of the field emission type image display apparatus.

Referring to FIG. 16, an anode electrode 8 is formed as one plane portion that covers matrix-shaped pixels composed of a large number of cathode electrodes 2 and patch-shaped gate electrodes 3. An anode lead electrode A is led out of the anode electrode 8. The cathode electrodes 2 are disposed opposite to the anode electrode 8 with a predetermined spacing. Cathode lead electrodes Cl to Cm are led out of the cathode electrodes 2.

In addition, the patch-shaped gate electrodes 3 are disposed opposite to the cathode electrodes 2 with an insulation. Gate lead electrodes GT1, GT2, . . . , GTn are led in a zigzag shape out of every second patch-shaped gate electrodes 3 of every two lines as shown in FIG. 14. The patch-shaped gate electrodes 3 have holes (not shown) through which electrons are emitted from the emitters.

Stripe-shaped G, R, and B phosphors are alternately coated opposite to the cathode electrodes 2 from the left to the right of the anode electrode 8 in the one-to-one relation. Pixels are composed of portions of which the patch-shaped gate electrodes 3 and the cathode electrodes 2 intersect. The line 1 is composed of pixels G11, R12, B13, G14, R15, B16, . . . , R1(m-1), and B1m. The line 2 is composed of pixels G21, G22, B23, . . . , R2(m-1), and B2m. The last line is composed of pixels Gn1, Rn2, Bn3, . . . , Rn(m-1), and Bnm.

The pixels Gi1 to Bnm are disposed in a matrix shape on the anode electrode 8. The gate lead electrodes GT1 to GTn are scanned and driven. Pixel data is supplied to the cathode lead electrodes Cl to Cm. Thus, the pixels are selected and the light emissions thereof are controlled.

FIG. 15 shows the driving circuit, which performs such a driving control. FIGS. 17(*a*) to 17(*l*) show timing charts of the driving circuit. FIGS. 18(*a*) to 18(*d*) show states of which pixels are lit. With reference to these drawings, the driving circuit will be described.

In the driving circuit according to the second embodiment shown in FIG. 15, the anode electrode is not divided, unlike the driving circuit according to the first embodiment shown in FIG. 10. Thus, the circuit that selectively drives the anode electrodes is omitted. The anode electrode of the second embodiment is always driven by an anode power supply. In addition, since anode electrodes are not selected, the selecting operation of pixels is performed by a color selecting circuit 57. Since the structures and operations of the other portions of the driving circuit of the second embodiment are the same as those of the first embodiment, their description is omitted.

FIG. 17(*a*) shows output pulses of a gate driver 60 that drives a gate lead electrode GT1. FIG. 17(*b*) shows output pulses of the gate driver 60 that drives a gate lead electrode GT2. FIG. 17(*c*) shows output pulses of the gate driver 60 that drives a gate lead electrode GT3. FIG. 17(*d*) shows output pulses of the gate driver 60 that drives a gate lead electrode GT4. FIG. 17(*e*) shows output pulses of the gate driver 60 that drives a gate lead electrode GTn.

FIG. 17(*f*) shows image data that is supplied from a cathode driver 63 to a cathode lead electrode C1. FIG. 17(*g*) shows image data that is supplied from the cathode driver 63 to a cathode lead electrode C2. FIG. 17(*h*) shows image data that is supplied from the cathode driver 63 to a cathode lead electrode C3. FIG. 17(*i*) shows image data supplied from the cathode driver 63 to a cathode lead electrode C4. FIG. 17(*j*) shows latch pulses that represent latch timings of latch circuits 59 and 62. FIG. 17(*k*) shows a shift clock supplied to a shift register 61. FIG. 17(*l*) shows image data supplied from buffer registers 55-1 55-2, and 55-3 to the shift register 61 in display order.

Next, with reference to FIGS. 17(*a*) to 17(*l*) and FIGS. 18(*a*) to 18(*d*), the operation of the driving circuit shown in FIG. 15 will be described.

The write timing of the image data is controlled by a memory write controlling circuit 53. Image data of each color is stored in a video memory 54 in synchronization with the clock generated by a clock generator 51. R, G, and B image data is read from memories 54-1, 54-2, and 54-3 and stored in buffer registers 55-1, 55-2, and 55-3 under the control of the color selecting circuit 57 and corresponding to an address of an address counter 56.

The output timings of the buffer registers 55-1, 55-2, and 55-3 are controlled by the color selecting circuit 57. The image data is supplied to the shift register 61 in the same display order of G, R, and B pixels hatched in FIG. 18. The shift register 61 shifts the image data corresponding to the shift clock S-CLK shown in FIG. 17(*k*).

When G, B, and R pixel data of half of a line of the patch-shaped gate electrodes 3 are shifted by the shift register 61 for two lines, the image data is latched by the latch circuit 62 corresponding to the latch pulses shown in FIG. 17(*j*). The output data of the latch circuit 62 is supplied to the cathode driver 63.

On the other hand, a display timing controlling circuit 52 supplies the latch pulses shown in FIG. 17(*j*) to a shift register 58 as shift pulses. The shift register 58 shifts a scan signal received from the controlling circuit 52. Since the output data of the shift register 58 is latched by the latch circuit 59 corresponding to the latch pulses, the latch circuit 59 outputs the scan signal that is shifted upon occurrence of the latch pulse. The scan signal is supplied to the gate driver 60.

Thus, the scan signal synchronizes with the G, R, and B image data that are output from the latch circuit 62.

Since the gate driver 60 successively applies the gate drive voltage to the gate lead electrodes GT1, GT2, . . . , and GTn of the image display apparatus 50 as shown in FIGS. 17(*a*), 17(*b*), 17(*c*), and 17(*d*), the gate lead electrodes GT1, GR2, . . . , and GTn are scanned at the timings of the latch pulses.

At this point, image data for two lines in a zigzag shape shown in FIGS. 17(*f*), 17(*g*), 17(*h*), and 17(*i*) are supplied from the cathode driver 63 to the cathode lead electrodes C1, C2, C3, C4, . . . and so forth in synchronization with the scanning of the gate lead electrodes GT1 to GTn. For example, when the gate lead electrode GTn is driven, as shown in FIGS. 17(*f*), 17(*g*), 17(*h*), and 17(*i*), image data corresponding to the pixel G(n+1) of the line (n+1), the pixel Rn2 of the line n, the pixel B(n+1)3 of the line (n+1), and the pixel Gn4 of the line n as shown in FIGS. 17(*f*), 17(*g*), 17(*h*), and 17(*i*) are supplied to the cathode lead electrodes C1, C2, C3, and C4, respectively.

In other words, when the gate lead electrode GT1 is selected and driven, as shown in FIG. 18, the light emissions of the even-numbered pixels R12, G14, B16, . . . and so forth of the line 1, and the odd-numbered pixels G21, B23, R25, . . . and so forth of the line 2 are controlled. In this case, the voltage of the gate electrode GT2 connected to the even-numbered pixels R22, G24, B26, . . . and so forth of the line 2 that are not driven is set to ground level.

Thus, as shown in FIG. 18(*a*), the light emissions of the half of the pixels of the line 1 and half of the pixels of the line 2 of the image display apparatus 50 are controlled. In addition, the emitted electrons are focused and reached to the anode electrode 8 by the adjacent gate electrodes 3 with voltages of ground level.

When the gate lead electrode GT2 is selected and driven at the timing of the next latch pulse, the even-numbered image data of the line 2 and the odd-numbered image data of the line 3 are shifted by the shift register 61 corresponding to the shift clock S-CLK. Thus, the light emissions of the even-numbered pixels of the line 2 and the odd-numbered pixels of the line 3 of the image display apparatus 50 are controlled as shown in FIG. 18(*b*).

As shown in FIG. 18(*c*), when the gate lead electrode GT3 is selected and driven at the timing of the next latch pulse, the even-numbered image data of the line 3 and the odd-numbered image data of the line 4 are shifted by the shift register 61 corresponding to the shift clock S-CLK. Thus, the light emissions of the even-numbered pixels of the line 3 and the odd-numbered pixels of the line 4 of the image display apparatus 50 are controlled.

In addition, when the gate lead electrode GTn is selected and driven at the timing of the last latch pulse of the frame, the even-numbered pixel data of the next line n and the odd-numbered image data of the line (n+1) are shifted by the shift register 61 corresponding to the shift clock S-CLK. The light emissions of the even-numbered pixels of the line n and the odd-numbered pixels of the line (n+1) of the image display apparatus 50 are controlled as shown in FIG. 18(*d*).

Since such scanning is successively performed, the light emissions of the pixels of one frame are controlled and the image is displayed.

According to the driving circuit of the second embodiment, since it is not necessary to scan the anode lead electrode, a high voltage can be applied to the anode electrode. Thus, the luminance of the image display apparatus can be further improved.

In addition, since the voltages of patch-shaped gate electrodes 3 disposed adjacent to patch-shaped gate electrode 3 that are selected and driven are set to ground level, electrons emitted from emitters are focused and thereby colors of the image can be prevented from being mixed.

Moreover, when the distance between the anode base and the cathode base is reduced, as shown in FIG. 5, the emitted electrons can be focused.

Figure 19:
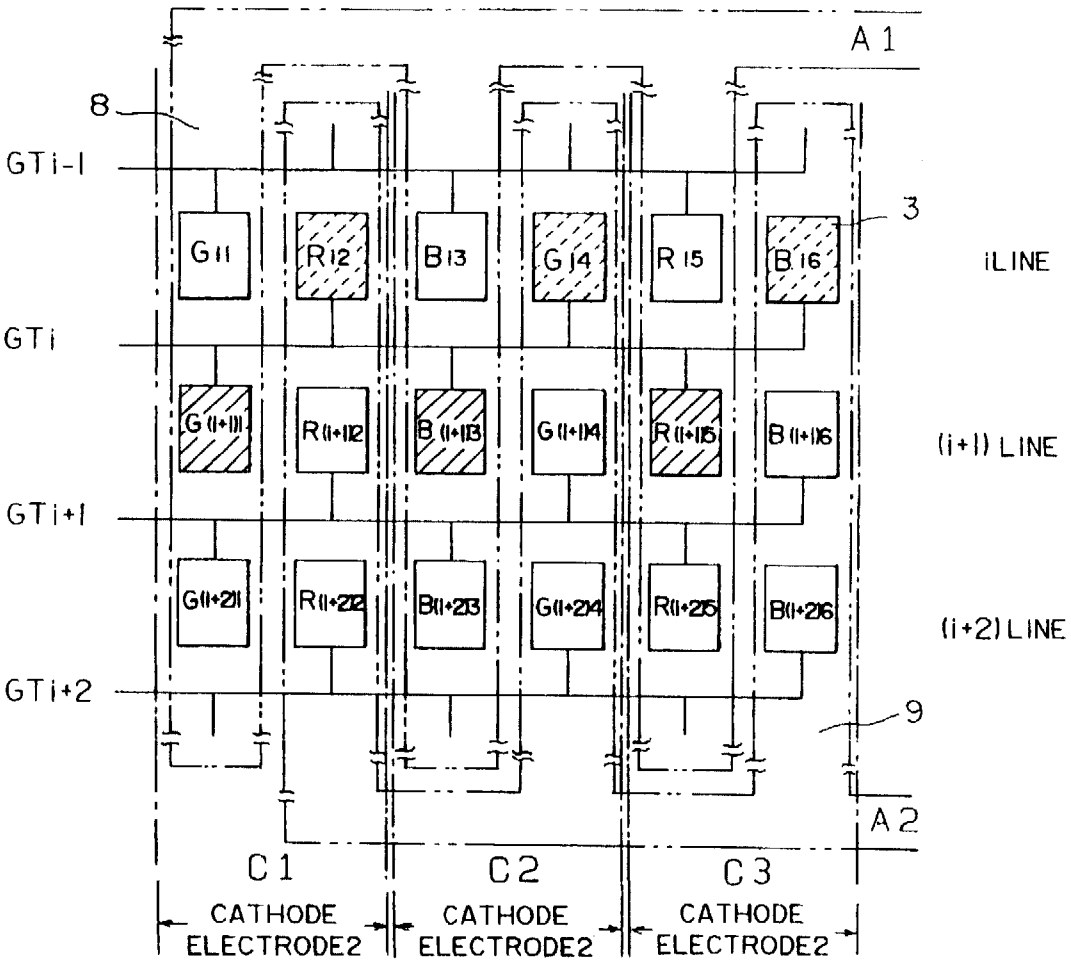
FIG. 19 is a schematic diagram showing relation among patch-shaped gate electrodes, gate lead electrodes, and cathode electrodes according to a modification of the second embodiment of the present invention.
Figure 22:
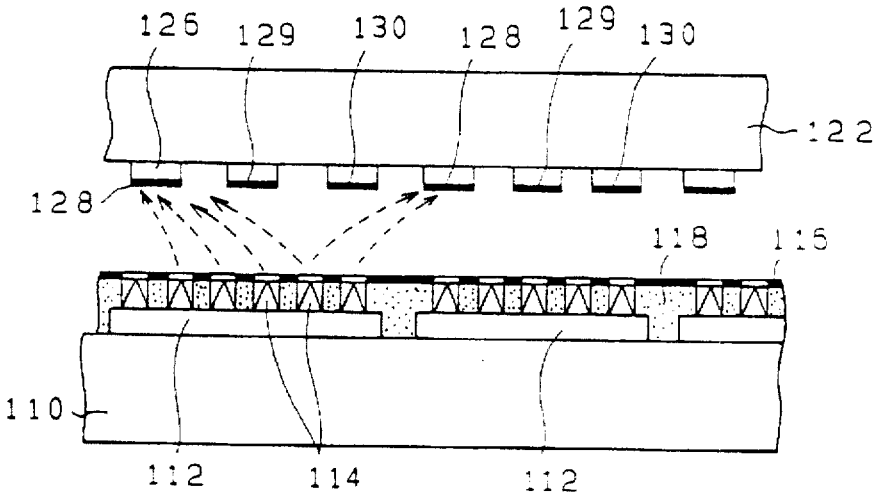
FIG. 22 (CONVENTIONAL ART)
FIG. 22 is a sectional view showing a conventional image display apparatus.
Figure 23:
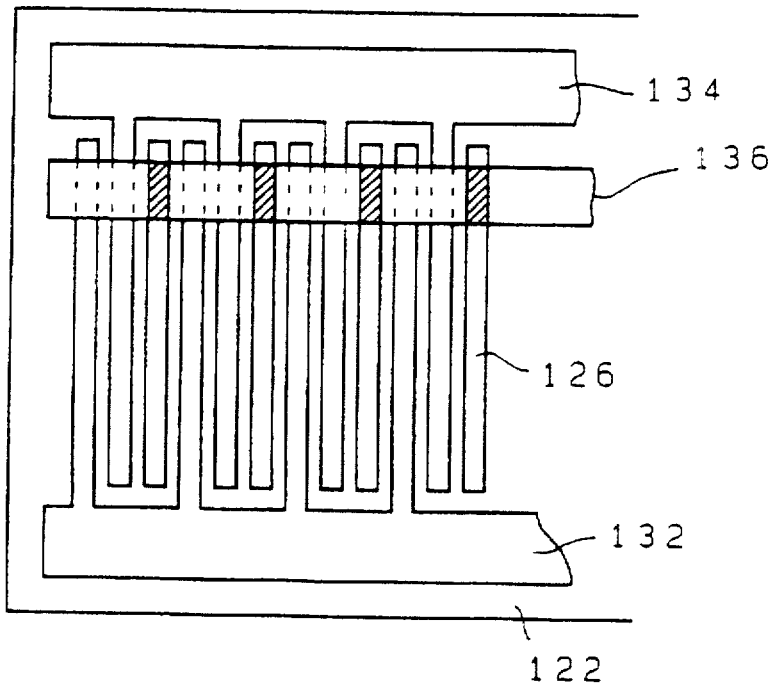
FIG. 23 (CONVENTIONAL ART)
FIG. 23 is a schematic diagram showing anode electrodes and anode lead electrodes of the conventional image display apparatus.

FIG. 19 shows the relation between patch-shaped gate electrodes 3 and gate lead electrodes GTi−1 to GTi+2 of a field emission type image display apparatus according to a modification of the second embodiment of the present invention. The sectional view of the field emission type image display apparatus according to this modification is nearly the same as that shown in FIG. 3(*a*).

Next, with reference to FIG. 19, the connections of patch-shaped gate electrodes 3 and gate lead electrodes C1, C2, C3, . . . and so forth will be described. The patch-shaped gate electrodes 3 corresponding to odd-numbered G, B, and R pixels Gi1, Bi3, Ri5, . . . and so forth of a line i are connected to a gate lead electrode GTi−1. The rest of the patch-shaped gate electrodes 3 corresponding to odd-numbered R, G, and B pixels Ri2, Gi4, Bi6, . . . of the line i are connected to a gate lead electrode GTi.

The patch-shaped gate electrodes 3 corresponding to odd-numbered G, B, and R pixels G(i+1)1, B(i+1)3, R(i+1)5 . . . and so forth of a line (i+1) are connected to the gate lead electrode GTi. The patch-shaped gate electrodes 3 corresponding to even-numbered R, G, and B pixels R(i−1)2, G(i−1)4, B(i−1)6, . . . and so forth are connected to a gate lead electrode GTi−1 (not shown). Likewise, even-numbered patch-shaped gate electrodes 3 of one of two lines and odd-numbered patch-shaped electrodes of the other line of the two lines are connected to the gate lead electrodes GT1 to GTn of the field emission type image display apparatus. The structure of the field emission type image display apparatus of the modification is the same as that of the second embodiment.

In the modification, pairs of patch-shaped electrodes 3 are disposed on each of cathode electrodes 2 in the line direction with an insulation. Anode electrodes 8 and 9 are disposed opposite to the patch-stated electrodes 3 in the row direction in the one-to-one relation. The cathode electrodes 2 are denoted by one-dashed lines. The anode electrodes 8 and 9 are denoted by two-dashed lines.

The odd-numbered anode electrodes 8 are connected to an anode lead electrode A1. The even-numbered anode electrodes 9 are connected to an anode lead electrode A2.

Next, with reference to timing charts shown in FIG. 20, the driving method according to the modification of the second embodiment will be described.

FIG. 20(*a*) shows output pulses of an anode driver that drives the anode lead electrode A1. FIG. 20(*b*) shows output pulses of the anode driver that drives the anode lead electrode A2. FIG. 20(*c*) shows output pulses of the gate driver that drives the gate lead electrode GTi−1. FIG. 20(*d*) shows output pulses of the gate driver that drives the gate lead electrode GTi. FIG. 20(*e*) shows output pulses of the gate driver that drives the gate lead electrode GTi+1. FIG. 20(*f*) shows output pulses of the gate driver that drives the gate lead electrode GTi+2. FIG. 20(*g*) shows image data supplied from the cathode driver to the cathode lead electrode C1. FIG. 20(*h*) is image data supplied from the cathode driver to the cathode lead electrode C2. FIG. 20(*i*) is image data supplied from the cathode driver to the cathode lead electrode C3.

In the timing charts, the gate lead electrodes GT1 to GTn are not shown. However, all the gate lead electrodes GT1 to GTn are successively scanned and driven as with the gate lead electrodes GTi−1 to GTi+2 that are shown. When the gate lead electrode GTi is driven, the even-numbered patch-shaped gate electrodes 3 of the line i hatched with dashed lines and the odd-numbered patch-shaped gate electrodes 3 of the line (i+1) hatched with solid lines are driven.

At this point, in the period of which each gate lead electrode is driven, the anode lead electrodes A1 and A2 are alternately selected and driven as shown in FIG. 19. Thus, when the anode lead electrode A2 is driven, the light emissions of the even-numbered pixels Ri2, Gi4, Bi6, . . . and so forth of the line i hatched with the dashed lines can be controlled. When the anode lead electrode A1 is driven, the light emissions of the odd-numbered pixels G(i+1)1, B(i+1)3, R(i+1)5, . . . , and so forth of the line (i+1) hatched with the solid lines can be controlled.

Image data is supplied to the cathode electrodes C1, C2, C3, . . . , and so forth corresponding to the patch-shaped gate electrodes 3 in the one-to-one relation as shown in FIGS. 20(*g*) to FIG. 20(*i*) in synchronization with the switching of the anode lead electrodes A1 and A2 so as to control the electrons emitted from the cathode electrodes corresponding to the image data. Thus, after all the gate lead electrodes GT1 to GTn have been successively scanned, an image of one frame can be displayed on the anode base.

In addition, the voltages of the anode lead electrodes that are not driven are set to a low level, preferably ground level. Moreover, the voltages of the gate lead electrodes (GTi−1 and GTi+1) that are disposed adjacent to the gate lead electrode (GTi) that is driven are set to ground level.

According to the modification of the second embodiment, the voltages of patch-shaped gate electrodes 3 disposed adjacent to each patch-shaped gate electrode 3 that is driven and hatched in FIG. 19 can be set to ground level. Thus, the electrons that are emitted through the gate electrodes can be focused. In addition, since the voltages of the anode electrodes 9 (8) disposed adjacent to each anode electrode 8 (9) that is driven are set to a low level, the electrons that are emitted from the gate electrodes can be more focused and thereby the leakage of light emissions can be prevented as much as possible.

Furthermore, since the structure of the field emission type image display apparatus according to the modification is equivalent to the case where each of adjacent two cathode electrodes 2 is connected, the number of cathode drivers can be halved.

Each cathode electrode 2 may be formed by connecting two adjacent cathode electrode members inside or outside a display tube.

As with the modification of the first embodiment, in the modification of the second embodiment, when the cathode electrodes are divided into two groups, the number of the gate lead electrodes can be halved in comparison with the case where a matrix of m×n pixels is driven (that requires m cathode drivers and n gate drivers). Thus, both the number of the gate drivers and the number of the cathode drivers can be halved.

In the driving methods of the first and second embodiments including the modifications thereof, since each gate driver 63 drives a capacitive load, a totem pole type rather than open collector type is preferable for high speed driving.

In the field emission type image display apparatuses according to the first and second embodiments including the above-described modifications, phosphors that emit rays of light of three primary colors of red, blue, and green were used. Instead, with a phosphor having a long wave length and filters having different wavelength characteristics, a plurality of colors such as red, blue, and green of light emissions may be displayed. Alternatively, with two color phosphors, a color image may be displayed.

The phosphors are normally coated on the anode electrode. Alternatively, phosphor films may be deposited on the anode electrode.

The phosphors may be formed in a dot pattern instead of a stripe pattern.

In the field emission device according to the present invention, since the voltages of patch-shaped gate electrodes disposed adjacent to a patch-shaped gate electrode that is driven are set to a low level, electrons that are emitted from the cathodes can be focused.

In addition, according to the first embodiment of the present invention and the modification thereof, the number of anode lead electrodes of the image display apparatus can be reduced to two without need to use a multilayer inter connection on both sides of the anode electrode base.

Moreover, since the anode electrodes are divided into two groups, the duty of the apparatus can be increased to ⅔ of the conventional structure of which the anode electrodes are divided into three groups. Thus, a brighter image can be displayed.

According to the field emission type image display apparatus of the second embodiment of the present invention, the number of anode lead electrodes can be reduced to one. Thus, a multilayer inter connection is not required. In addition, since the duty of the apparatus can be tripled, the luminance can be more increased.

Since the voltages of anode electrodes and patch-shaped gate electrodes disposed adjacent to each anode electrode and/or patch-shaped gate electrode that is selected and driven are set to the ground level, electrons that are emitted can be focused. Thus, a color image that is free of dullness can be obtained.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

We claim:

1. A field emission type image display apparatus, comprising:

a plurality of stripe-shaped cathode electrodes disposed on a first base and having emitters corresponding thereto for performing field emissions;

a plurality of cathode lead electrodes for supplying signals to said cathode electrodes;

a plurality of patch-shaped gate electrodes disposed on said cathode electrodes in a matrix shape with an insulation;

a first gate lead electrode connected to odd-numbered ones of said patch-shaped gate electrodes disposed on each line of said patch-shaped gate electrodes disposed in the direction nearly perpendicular to said cathode electrodes;

a second gate lead electrode connected to the remaining even-numbered ones of said patch-shaped gate electrode on the same line of said first gate lead electrode;

a second base spaced apart from said first base by a predetermined distance;

a plurality of stripe-shaped anode electrodes disposed on said second base and opposite to said cathode electrodes;

a plurality of phosphor members successively disposed on said stripe-shaped anode electrodes and adapted for displaying an image;

a first anode lead electrode connected to odd-numbered ones of said stripe-shaped anode electrodes; and a second anode lead electrode connected to the remaining even-numbered ones of said stripe-shaped anode electrodes, wherein a row of said patch-shaped gate electrodes is disposed just below said stripe-shaped anode electrodes.

2. The field emission type image display apparatus as set forth in claim 1, wherein said stripe-shaped cathodes electrodes are divided into two groups in the line direction, wherein said patch-shaped gate electrodes are divided into two groups in the line direction, and wherein said first gate lead electrode is connected to each line of one of the two groups and said second gate lead electrode is connected to the corresponding line of the other of the two groups.

3. The field emission type image display apparatus as set forth in claim 1, wherein a signal that is received from one of said cathode lead electrodes is supplied to one of said cathode electrodes disposed opposite to the pairs of said patch-shaped electrodes disposed in the line direction.

4. The field emission type image display apparatus as set forth in claim 3, wherein said cathode electrodes are divided into two groups in the line direction, wherein said patch-shaped gate electrodes are divided into two groups in the line direction, and wherein said first gate lead electrode is connected to each line of one of the two groups and said second gate lead electrode is connected to the corresponding line of the other of the two groups.

5. The field emission type image display apparatus as set forth in claim 1, wherein each of said patch-shaped gate electrodes of each line of the matrix is disposed on a corresponding one of said cathode electrodes.

6. The field emission type image display apparatus as set forth in claim 5, wherein said cathode electrodes are divided into two groups in the line direction, wherein said patch-shaped gate electrodes are divided into two groups in the line direction, and wherein said first gate lead electrode is connected to each line of one of the two groups and said second gate lead electrode is connected to the corresponding line of the other of the two groups.

7. The field emission type image display apparatus as set forth in claim 5, wherein a signal that is received from one of said cathode lead electrodes is supplied to one of said cathode electrodes disposed opposite to the pairs of said patch-shaped electrodes disposed in the line direction, wherein said stripe-shaped anode electrodes are disposed on each row of said patch-shaped electrodes, and wherein two anode lead electrodes are connected to odd-numbered ones and even-numbered ones of said stripe-shaped anode electrodes, respectively.

8. The field emission type image display apparatus as set forth in claim 7, wherein said cathode electrodes are divided into two groups in the line direction, wherein said patch-shaped gate electrodes are divided into two groups in the line direction, and wherein said gate lead electrode is led out of each line of one of the two groups and the corresponding line of the other of the two groups.

9. A field emission type image display apparatus, comprising:

a plurality of stripe-shaped cathode electrodes disposed on a first base and having emitters corresponding thereto for performing field emissions;

a plurality of cathode lead electrodes for supplying signals to said cathode electrodes;

a plurality of patch-shaped gate electrodes disposed on said cathode electrodes in a matrix shape with an insulation;

gate lead electrodes led out of a portion between two lines of the matrix, said gate lead electrodes being connected to odd-numbered patch-shaped gate electrodes of one of said two lines and to even-numbered patch-shaped gate electrodes of the other line of said two lines;

a plane-shaped anode electrode disposed on a second base spaced apart from said first base by a predetermined distance so that said plane-shaped anode electrode is disposed opposite to all of said patch-shaped gate electrodes; and a plurality of stripe-shaped phosphor members disposed on said plane-shaped anode electrode and opposite to said cathode electrodes in a one-to-one relation.

10. The field emission type image display apparatus as set forth in claim 9, wherein said cathode electrodes are divided into two groups in the line direction, wherein said patch-shaped gate electrodes are divided into two groups in the line direction, and wherein said gate lead electrode is led out of each line of one of the two groups and the corresponding line of the other of the two groups.

11. A driving method for driving a field emission type image display apparatus having:

a plurality of stripe-shaped cathode electrodes disposed on a first base and having emitters corresponding thereto for performing field emissions, a plurality of cathode lead electrodes for supplying signals to said cathode electrodes, a plurality of patch-shaped gate electrodes disposed on said cathode electrodes in a matrix shape with an insulation, a first gate lead electrode connected to odd-numbered ones of said patch-shaped gate electrodes disposed on each line of said patch-shaped gate electrodes disposed in the direction nearly perpendicular to said cathode electrodes, a second gate lead electrode connected to the remaining even-numbered ones of said patch-shaped gate electrode on the same line of said first gate lead electrode, a second base spaced apart from said first base by a predetermined distance, a plurality of stripe-shaped anode electrodes disposed on said second base and opposite to said cathode electrodes, a plurality of phosphor members successively disposed on said stripe-shaped anode electrodes and adapted for displaying an image.

a first anode lead electrode connected to odd-numbered ones of said stripe-shaped anode electrodes, and a second anode lead electrode connected to the remaining even-numbered ones of said stripe-shaped anode electrodes.

said driving method comprising the steps of:

selecting and driving said first gate lead electrode and said second gate lead electrode so as to alternately scan said first gate lead electrode and said second gate lead electrode;

setting the voltage of said first gate lead electrode or said second gate lead electrode that is not driven to a low level so that the voltages of said patch-shaped gate electrodes disposed adjacent to one of said patch-shaped gate electrodes that is selected and driven become a low level; and setting the voltages of said anode electrodes that are not selected and driven to a low level.

whereby electrons emitted from the emitters are focused.

12. The driving method as set forth in claim 11.

wherein a signal that is received from one of said cathode lead electrodes is supplied to one of said cathode electrodes disposed opposite to the pairs of said patch-shaped electrodes disposed in the line direction, and wherein said driving method comprises the steps of:

selecting and driving said first gate lead electrode and said second gate lead electrode so as to alternately scan said first gate lead electrode and said second gate lead electrode;

setting the voltage of said first gate lead electrode or said second gate lead electrode that is not driven to a low level so that the voltages of said patch-shaped gate electrodes disposed adjacent to one of said patch-shaped gate electrodes that is selected and driven become a low level; and setting the voltages of said anode electrodes that are not selected and driven to a low level.

whereby electrons emitted from the emitters are focused.

13. The driving method as set forth in claim 11.

wherein said patch-shaped electrodes are disposed corresponding to said cathode electrodes in the direction of each line of the matrix in one-to-one relation, and wherein said driving method comprises the steps of:

selecting and driving said first gate lead electrode and said second gate lead electrode so as to alternately scan said first gate lead electrode and said second gate lead electrode;

setting the voltage of said first gate lead electrode or said second gate lead electrode that is not driven to a low level so that the voltages of said patch-shaped gate electrodes disposed adjacent to one of said patch-shaped gate electrodes that is selected and driven become a low level; and setting the voltages of said anode electrodes that are not selected and driven to a low level.

whereby electrons emitted from the emitters are focused.

14. The driving method as set forth in claim 11.

wherein said cathode electrodes are divided into two groups in the line direction, wherein said patch-shaped gate electrodes are divided into two groups in the line direction, wherein said first gate lead electrode is connected to each line of one of the two groups and said second gate lead electrode is connected to the corresponding line of the other of the two groups, and wherein said driving method comprises the steps of:

selecting and driving said first gate lead electrode and said second gate lead electrode so as to alternately scan said first gate lead electrode and said second gate lead electrode;

setting the voltage of said first gate lead electrode or said second gate lead electrode that is not driven to a low level so that the voltages of said patch-shaped gate electrodes disposed adjacent to one of said patch-shaped gate electrodes that is selected and driven become a low level; and setting the voltages of said anode electrodes that are not selected and driven to a low level.

whereby electrons emitted from the emitters are focused.

15. A driving method for driving a field emission type image display apparatus having:

a plurality of stripe-shaped cathode electrodes disposed on a first base and having emitters corresponding thereto for performing field emissions.

a plurality of cathode lead electrodes for supplying signals to said cathode electrodes;

a plurality of patch-shaped gate electrodes disposed on said cathode electrodes in a matrix shape with an insulation.

gate lead electrodes led out of a portion between two lines of the matrix, said gate lead electrodes being connected to odd-numbered patch-shaped gate electrodes of one of said two lines and to even-numbered patch-shaped gate electrodes of the other line of said two lines.

a plane-shaped anode electrode disposed on a second base spaced apart from said first base by a predetermined distance so that said plane-shaped anode electrode is disposed opposite to all of said patch-shaped gate electrodes, and a plurality of stripe-shaped phosphor members disposed on said plane-shaped anode electrode and opposite to said cathode electrodes in a one-to-one relation.

said driving method comprising the steps of:

successively selecting and driving said gate lead electrodes so as to scan said gate lead electrodes; and setting the voltages of said gate lead electrodes that are not selected and driven to a low level so that the voltages of said patch-shaped gate electrodes that are disposed adjacent to one of said patch-shaped gate electrodes that is selected and driven become a low level, whereby electrons emitted from the emitters are focused.

16. The driving method as set forth in claim 15.

wherein said cathode electrodes are divided into two groups in the line direction, wherein said patch-shaped gate electrodes are divided into two groups in the line direction, wherein said first gate lead electrode is connected to each line of one of the two groups and said second gate lead electrode is connected to the corresponding line of the other of the two groups, and wherein said driving method comprises the steps of:

successively selecting and driving said gate lead electrodes so as to scan said gate lead electrodes; and setting the voltages of said gate lead electrodes that are not selected and driven to a low level so that the voltages of said patch-shaped gate electrodes that are disposed adjacent to one of said patch-shaped gate electrodes that is selected and driven become a low level, whereby electrons emitted from the emitters are focused.

17. A driving method for driving a field emission type image display apparatus having:

a plurality of stripe-shaped cathode electrodes disposed on a first base and having emitters corresponding thereto for performing field emissions, a plurality of cathode lead electrodes for supplying signals to said cathode electrodes, a plurality of patch-shaped gate electrodes disposed on said cathode electrodes in a matrix shape with an insulation, gate lead electrodes led out of a portion between two lines of the matrix, said gate lead electrodes being connected to odd-numbered patch-shaped gate electrodes of one of said two lines and to even-numbered patch-shaped gate electrodes of the other line of said two lines:

a plane-shaped anode electrode disposed on a second base spaced apart from said first base by a predetermined distance so that said plane-shaped anode electrode is disposed opposite to all of said patch-shaped gate electrodes, and a plurality of stripe-shaped phosphor members disposed on said plane-shaped anode electrode and opposite to said cathode electrodes in a one-to-one relation, wherein said cathode electrodes are divided into two groups in the line direction, wherein said patch-shaped gate electrodes are divided into two groups in the line direction, and wherein said gate lead electrodes are led out of each line of one of the two groups and the corresponding line of the other of the two groups, said driving method comprising:

successively selecting and driving said gate lead electrodes so as to scan said gate lead electrodes; and setting the voltages of said gate lead electrodes that are not selected and driven to a low level so that the voltages of said patch-shaped gate electrodes that are disposed adjacent to one of said patch-shaped gate electrodes that is selected and driven become a low level, whereby electrons emitted from the emitters are focused.

* * * * *